US006719403B2

(12) United States Patent
Kanda et al.

(10) Patent No.: US 6,719,403 B2
(45) Date of Patent: Apr. 13, 2004

(54) INK-JET PRINTING APPARATUS AND INK-JET PRINTING METHOD

(75) Inventors: Hidehiko Kanda, Kanagawa (JP); Jiro Moriyama, Kanagawa (JP); Yoshinori Nakagawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/996,910

(22) Filed: Nov. 30, 2001

(65) Prior Publication Data

US 2002/0067393 A1 Jun. 6, 2002

(30) Foreign Application Priority Data

Nov. 30, 2000 (JP) ..... 2000-366291

(51) Int. Cl.[7] ..... B41J 2/145; B41J 2/15; B41J 29/38

(52) U.S. Cl. ..... 347/40; 347/16

(58) Field of Search ..... 347/40, 12, 9, 347/14, 19, 43, 16

(56) References Cited

U.S. PATENT DOCUMENTS

| | | | | |
|---|---|---|---|---|
| 5,568,168 A | * | 10/1996 | Watanabe | 347/43 |
| 5,696,542 A | | 12/1997 | Matsubara | 347/12 |
| 6,086,181 A | * | 7/2000 | Majette et al. | 347/16 |
| 6,086,185 A | | 7/2000 | Inui | 347/43 |
| 6,116,720 A | | 9/2000 | Inui | 347/43 |
| 6,137,505 A | | 10/2000 | Hirabayashi et al. | 347/40 |
| 6,164,756 A | | 12/2000 | Takahashi et al. | 347/43 |
| 6,378,982 B2 | | 4/2002 | Ono | 347/41 |

FOREIGN PATENT DOCUMENTS

| | | |
|---|---|---|
| JP | 6-135014 | 5/1994 |
| JP | 6-143618 | 5/1994 |

* cited by examiner

*Primary Examiner*—Thinh Nguyen
(74) *Attorney, Agent, or Firm*—Fitzpatrick, Cella, Harper & Scinto

(57) ABSTRACT

A high-quality image is printed with reduced bleeding in colors that may appear at a boundary between a black image and a color image. A head for ejecting black ink and a head for ejecting color ink perform three times of scanning while feeding is carried out therebetween for moving the printing medium by four pitches of ejection openings arranged on the heads, different ejection openings are caused to correspond to a scanning area, which corresponds to the four pitches, and multi-pass printing is performed to complete printing on the area. The black head completes printing of the black image, and then, the color head completes printing of the color image adjacent to the black image. The arrangement of ejection openings is determined so that between last scanning for completing printing of the black image and the first scanning for printing of the color image, scanning with no performing printing exists.

37 Claims, 21 Drawing Sheets

INK-JET PRINTING APPARATUS AND INK-JET PRINTING METHOD

This application is based on Patent Application No. 2000-366291 filed Nov. 30, 2000 in Japan, the content of which is incorporated hereinto by reference.

BACKGROUND OF THE INVENTION

1. Field of the Invention

The present invention relates to an ink-jet printing method and an ink-jet printing apparatus and specifically to a configuration for reducing bleeding at a boundary between black and color image areas printed when black ink and other kinds of color ink are used for printing.

2. Description of the Related Art

A printing apparatus having a function of a printer, a copy machine, a facsimile or the like, or a printing apparatus used as an output device of information processed in a composite electronic device including a computer and a word processor, a work station and so on, is structured so that images (including characters and so on) are printed on a printing medium such as a printing sheet and a plastic thin plate based on image information (including character information). Such a printing apparatus is, by a printing method, classified into an ink-jet system, a wire dot system, a thermal transfer system, a laser beam system and the like. Among them, a printing apparatus using the ink-jet system (hereinafter, referred to as an ink-jet printing apparatus) performs printing by ejecting ink to a printing medium from a printing head, and has many advantages such that high resolution printing can be achieved more easily than other printing systems, high-speed and high quiet printing can be performed, and a device is available at relatively low cost.

Such ink-jet printing apparatus on the other hand has been much requested to be able to perform color printing, and a number of color ink-jet printing apparatuses have been provided. In general, in order to improve a printing speed and so on, as a printing head having a plurality of printing elements arranged integrally, the ink jet printing apparatus uses a printing head, in which a plurality of ink ejection openings and ink paths, that compose ink ejection portions, are integrated, and further includes a plurality of printing heads for respective colors of ink to be adapted to color printing.

FIG. 1 is a perspective view mainly showing an example of a schematic configuration of a printing section in an ink-jet printing apparatus.

In FIG. 1, printing heads 102 and ink cartridges 101 are detachably mounted on a carriage 106 and are used for printing. More specifically, the printing heads and the ink cartridges are used correspondingly to color inks of black (Bk), cyan (C), magenta (M), and yellow (Y), respectively and the printing heads for the respective inks are scanned for printing by the move of the carriage 106. Hereinafter, the above mentioned scanning is referred to as main scanning and its direction is referred to as a main scanning direction. The carriage 106 is engaged to a guide shaft 107 so as to slide thereon. The carriage 106 can be moved thus along the guide shaft 107 by driving of a driving mechanism such as a motor and a belt (not shown).

FIG. 2 shows ejection openings disposed on each of the printing heads 102, taken along direction "z" (FIG. 1). In FIG. 2, reference numeral 201 denotes n ejection openings arranged on the printing head 102, and the ejection openings are arranged at a density of N dpi. A variety of ejection systems may be adopted for such a printing head. For example, a method may be applicable in which a bubble is produced in ink by using thermal energy generated by an electro-thermal converter and ink is ejected by pressure of the bubble.

Referring to FIG. 1 again, reference numeral 103 denotes a paper feeding roller, which rotates in a direction shown by an arrow in FIG. 1 while pressing a printing sheet P in cooperation with an auxiliary roller 104 to on necessary move the printing sheet P as a printing medium in y direction (hereinafter, referred to as a "sub-scanning direction"). Further, reference numeral 105 denotes a paper feeding roller, which feeds printing sheets and also functions as applying constant tension to the printing sheet P similarly to the rollers 103 and 104.

During a non-printing operation, the carriage 106 is shifted to a home position h and waits for a printing command. During a printing operation, the carriage 106 moves in x direction to scan the printing heads 102 of respective inks. During this scanning operation, ejecting ink from the respective n ejection openings 201 in accordance with image information can perform printing. When the above main scanning completes printing of image information on the end of a printing sheet P, the carriage returns to a printing start position while the printing sheet P is moved at a predetermined amount. Thereafter, scanning and printing in x direction are repeated.

When an image and the like are printed, a variety of image-quality elements are demanded including coloring, gradation, and a uniform density of a printed image. Particularly, it has been known that regarding the uniform density, due to slight unevenness of ejection openings on manufacturing that occurs in a process of manufacturing a printing head, an amount of ejected ink and an ejecting direction may vary among the ejection openings, resulting in uneven density of the printed image.

A specific example of such occurrence of uneven density will be explained referring to FIGS. 3A to 3C and 4A to 4C. In FIG. 3A, reference numeral 31 denotes a printing head, which is composed of eight ejection openings 32. Reference numeral 33 denotes ink drops (ink droplets) ejected from the eight ejection openings 32. Ink is ideally ejected with substantially an equal amount and substantially in the same direction as shown in FIG. 3A. Such ideal ejection would form ink dots substantially equal in size on a printing sheet as shown in FIG. 3B, and entirely obtain a uniform image without variation in density (FIG. 3C).

However, as described above, ejection openings actually have unevenness to some extent. In this case, when printing is performed in the above manner, as shown in FIG. 4A, ink drops ejected from the ejection openings vary in size and direction, resulting in ink dots of FIG. 4B that are varied in size and printing position on a printing sheet.

Consequently, for example, a part on a printing sheet, which do not satisfy 100% of an area factor and come out as a ground of the printing sheet, appears periodically in a direction of aligning the ejection openings, resulting in white bands. Or conversely, an image including a part, in which dots formed overlap each other more than necessary, resulting in a black band, is printed. In other words, such an image has a density distribution shown in FIG. 4C in a direction of aligning the ejection openings. The density distribution is visually recognized as an uneven density. Moreover, bands may appear due to variations in an amount of feeding printing sheets.

As a solution for such uneven density, for example, Japanese Patent Laid-Open No. 06-143618 discloses the following method. Referring to FIGS. 4A to 4C and FIGS. 5A to 5C, the method will be explained briefly.

As shown in FIG. 5A, this method completes printing for the same printing area as that shown in FIG. 4B by three times of scanning of the printing head 31, between which the printing sheet is moved at an amount corresponding to four pitches of ejection openings. More specifically, a scanning area, which is equivalent to a half of the above mentioned printing area and corresponds to four ejection openings, is completed by two times of scanning. At this moment, for the scanning area, in the first scanning lower four of the eight ejection openings of the printing head is used. In the second scanning after feeding at an amount corresponding to four ejection openings, upper four ejection openings are used for printing. And, in the first scanning for each of the ejection openings, printing is performed on image data which is thinned out to about a half according to a predetermined thinning pattern. In the second scanning, printing is performed on the remaining half of the image data so as to complete printing. Hereinafter, such a printing method is referred to as a multi-pass printing method.

According to the multi-pass printing method, even in the case of using a printing head including ejection openings having unevenness in ejecting characteristics as shown in FIGS. 4A to 4C, variations in dot size and printing position due to this unevenness is dispersed. Then, as shown in FIG. 5B, a printed image has no irregularity of dot formation as recognized as the black band or the white band and is recognized as a substantially even distribution of density shown in FIG. 5C.

When such multi-pass printing is carried out, thinning is performed based on thinning patterns, which are complementary to each other, in the first scanning and the second scanning. As pixel patterns for this thinning pattern, as shown in FIGS. 6A to 6C, checkered patterns are generally used for pixels in rows and columns. In this case, in the first scanning, pixels corresponding to black parts as shown in FIG. 6A of the checkered pattern are printed, and in the second scanning, pixels corresponding to white parts as shown in FIG. 6B are printed, then printing is entirely completed (FIG. 6C).

As described above, for each line composed of dots arranged in the scanning direction, two different ejection openings are used so that printing of image performed. Hence, it is possible to obtain a high-quality image with reduced unevenness in density.

In addition to the above technique for reducing variations in density, as another factor for improving the picture quality of a printed image, a technique for preventing bleeding at a boundary between a black image and a color image has been known. For example, Japanese Patent Laid-Open No. 06-135014 discloses a method for using a predetermined ejection portion of an ejection opening group for ejecting black ink when a black image printed with black ink and a color image printed with color ink are adjacent to each other. Hence, scanning for printing a black image is separated from scanning for printing a color image, and the scanning is not performed sequentially. More specifically, since another scanning is executed between the scanning for printing a black image and the scanning for printing a color image, which is adjacent to the black image, it is possible to provide time for fixing a previously printed image such as the black image, thereby achieving high-quality printing for reducing the bleeding at the boundary between the black image and the color image.

However, in the case of using the multi-pass printing mentioned before, when it is intended that the bleed at a boundary (hereinafter, also referred to as "bleeding in colors") is reduced between the black image and the color image, the method of Japanese Patent Laid-Open No. 06-135014 cannot be used as it is. More specifically, in the method disclosed in the above publication, the black image and the color image are printed by a single scanning of a printing head (hereinafter, referred to as "one-pass printing"). Hence, the method is different in precondition from the case using the multi-pass printing, by which printing on a predetermined area is completed by a plurality of times of scanning. Therefore, even when the method is used as it is, scanning for obtaining fixing time cannot be provided.

Further, in addition to the bleeding in colors, the one-pass printing and the multi-pass printing are different from each other regarding a phenomenon in which a printed part appears whitish by interference of inks when inks of a plurality of colors land on a printing medium. Such a difference in the phenomenon appears because the multi-pass printing is different from the one-pass printing in permeation and fixing conditions of ink to the printing medium due to fewer dots printed in a unit area for unit time in the multi-pass printing, as well as because the multi-pass printing has the effect of preventing print density from becoming uneven.

SUMMARY OF THE INVENTION

The object of the present invention is to provide an ink-jet printing method and an ink-jet printing apparatus for printing a high-quality image with reduced bleeding in colors that may appear in multi-pass printing.

In a first aspect of the present invention, there is provided an ink jet printing method of performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a discharge side regarding moving of the printing medium at a distance $(m+a)\times L$ (a is positive integer),which is measured as a distance between respective ejection openings located at a feed side ends regarding the moving of the printing medium.

In a second aspect of the present invention, there is provided an ink jet printing method of performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a feed side regarding moving of the printing medium at a distance (m+a)×L (a is positive integer),which is measured as a distance between respective ejection openings located at a discharge side ends regarding the moving of the printing medium.

In a third aspect of the present invention, there is provided an ink jet printing method of performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a discharge side regarding moving of the printing medium at a distance which is larger than (m+a)×L (a is positive integer) and is shorter than (m+a+1)×L, the distance being measured as a distance between respective ejection openings located at a feed side ends regarding the moving of the printing medium.

In a forth aspect of the present invention, there is provided an ink jet printing method of performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a feed side regarding moving of the printing medium at a distance which is larger than (m+a)×L (a is positive integer) and is shorter than (m+a+1)×L, the distance being measured as a distance between respective ejection openings located at a discharge side ends regarding the moving of the printing medium.

In a fifth aspect of the present invention, there is provided an ink jet printing method of performing printing by using a printing head having a first ejection opening row including a plurality of ejection openings ejecting a first kind of ink and a second ejection opening row including a plurality of ejection openings ejecting a second kind of ink different from the first kind of ink and by ejecting ink to a printing medium from the printing head, the method comprising the step:

controlling the printing for an area, which has a length corresponding to a divided length of an ejection opening arranged length of at least one of the first and second ejection opening rows, to be completed by scanning the at least one of the first and second ejection opening rows to the area a plurality of times, between successive two times of scanning the printing medium is moved at a distance of the divided length, and assigning different ejection opening to the area from each of the plurality of times of scanning, wherein printing of a first image is completed by using the first kind of ink ejected by the first ejection row, then printing of a second image adjacent to the first image completed is completed by using the second kind of ink ejected by the second ejection row, and the time of scanning in which printing is not performed on the area of the first image exists between the time of a last scanning for completing the first image and the time of a first scanning for printing the second image.

In a sixth aspect of the present invention, there is provided an ink jet printing apparatus for performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a discharge side regarding moving of the printing medium at a distance (m+a)×L (a is positive integer),which is measured as a distance between respective ejection openings located at a feed side ends regarding the moving of the printing medium.

In a seventh aspect of the present invention, there is provided an ink jet printing apparatus for performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a feed side regarding moving of the printing medium at a distance (m+a)×L (a is positive integer),which is measured as a distance between respective ejection openings located at a discharge side ends regarding the moving of the printing medium.

In an eighth aspect of the present invention, there is provided an ink jet printing apparatus for performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a discharge side regarding moving of the printing medium at a distance which is larger than (m+a)×L (a is positive integer) and is shorter than (m+a+1)×L, the distance being measured as a distance between respective ejection openings located at a feed side ends regarding the moving of the printing medium.

In a ninth aspect of the present invention, there is provided an ink jet printing apparatus for performing printing by ejecting ink to a printing medium from a printing head while scanning the printing head relatively to the printing medium, wherein the printing head is provided, for at least two kinds of ink, with ejection opening rows each including a plurality of ejection openings arranged in a direction different from a direction of the scanning, printing is performed in which the number of times of scanning is m (m is positive integer), which is required for completing an image by means of a first ejection opening row set for use out of the ejection opening rows for the at least two kinds of ink, and the number of times of scanning is n (n is positive integer), which is required for completing an image by means of a second ejection opening row set for use out of the ejection opening rows for the at least two kinds of ink, where at least one of m and n is 2 or more, and an amount at which the printing medium is moved for each time of the scanning in a direction different form the direction of the scanning is L (L is positive integer), and the second ejection opening row is parted from the first ejection opening row toward a feed side regarding moving of the printing medium at a distance which is larger than (m+a)×L (a is positive integer) and is shorter than (m+a+1)×L, the distance being measured as a distance between respective ejection openings located at a discharge side ends regarding the moving of the printing medium.

In a tenth aspect of the present invention, there is provided an ink jet printing apparatus for performing printing by using a printing head having a first ejection opening row including a plurality of ejection openings ejecting a first kind of ink and a second ejection opening row including a plurality of ejection openings ejecting a second kind of ink different from the first kind of ink and by ejecting ink to a printing medium from the printing head, the apparatus comprising:

control means for controlling the printing for an area, which has a length corresponding to a divided length of an ejection opening arranged length of at least one of the first and second ejection opening rows, to be completed by scanning the at least one of the first and second ejection opening rows to the area a plurality of times, between successive two times of scanning the printing medium is moved at a distance of the divided length, and assigning different ejection opening to the area from each of the plurality of times of scanning, wherein printing of a first image is completed by using the first kind of ink ejected by the first ejection row, then printing of a second image adjacent to the first image completed is completed by using the second kind of ink ejected by the second ejection row, and the time of scanning in which printing is not performed on the area of the first image exists between the time of a last scanning for completing the first image and the time of a first scanning for printing the second image.

According to the above structure, when so-called multi-pass printing is performed, for the first and the second ejection opening rows, the positions of the ejection openings located at ends of the respective first and the second ejection opening rows on a paper feeding side or a paper discharging side in connection with feeding of a printing medium are apart from each other at a distance of (m+a)×L (a: positive integer) in a discharging or feeding direction for conveying a printing medium. Or between scanning for completing printing on a first image and first scanning for printing a second image, scanning with performing no printing is executed for an area on which the first image has been printed. Hence, printing an image by the first ejection opening row and printing an image, which is adjacent to the image by the first ejection opening row, by the second ejection opening row are performed while at least a single scanning is executed therebetween. Therefore, it is possible to provide time for fixing ink by the first ejection opening row onto the printing medium.

The above and other objects, effects, features and advantages of the present invention will become more apparent from the following description of embodiments thereof taken in conjunction with the accompanying drawings.

DETAIL DESCRIPTION OF THE PREFERRED EMBODIMENT

The embodiments of the present invention will be explained in detail by referring to accompanied drawings.

Figure 1:
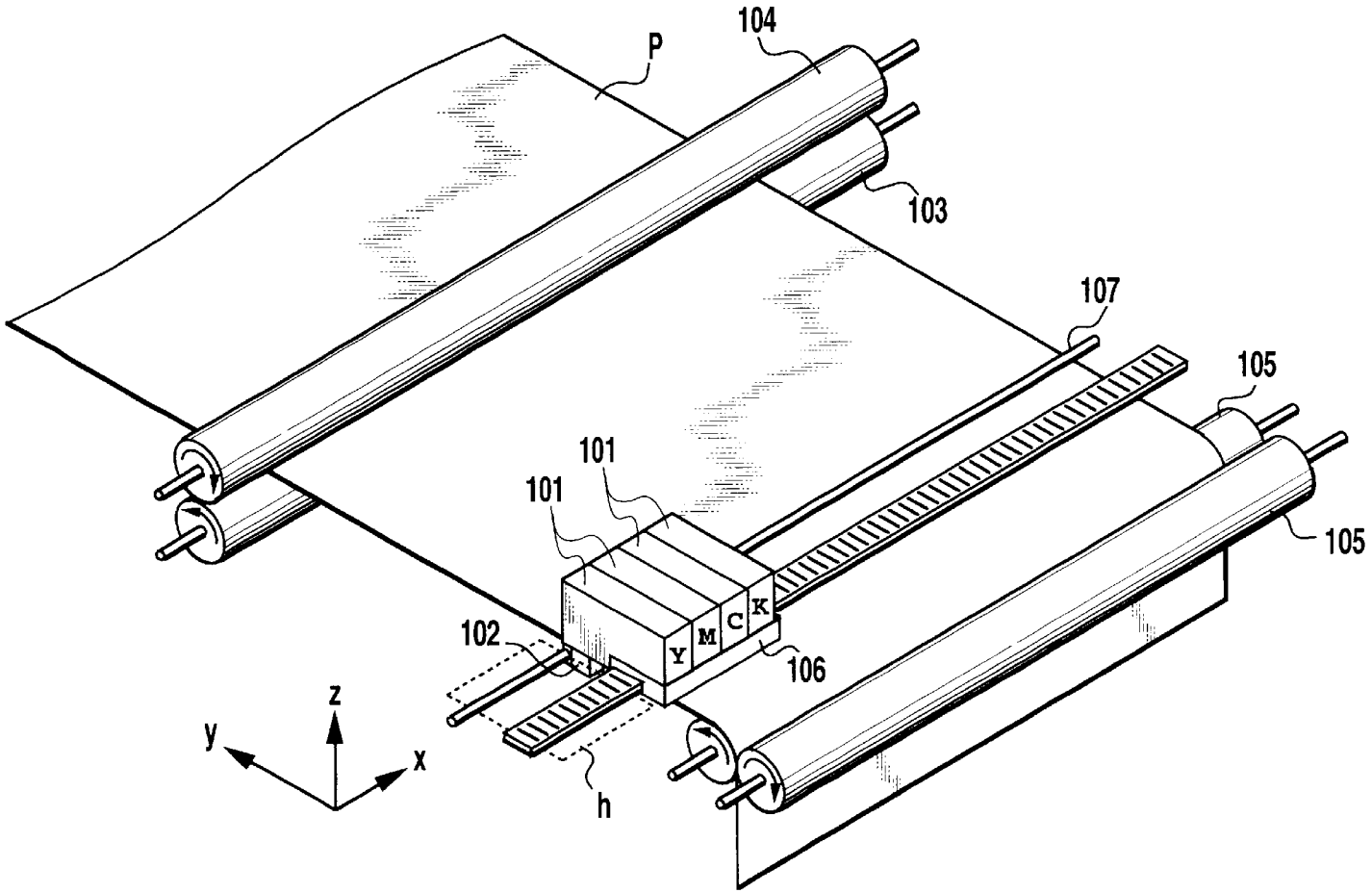
FIG. 1 is a perspective view schematically showing a main part of an ink-jet printing apparatus to which the present invention is applicable.
Figure 2:
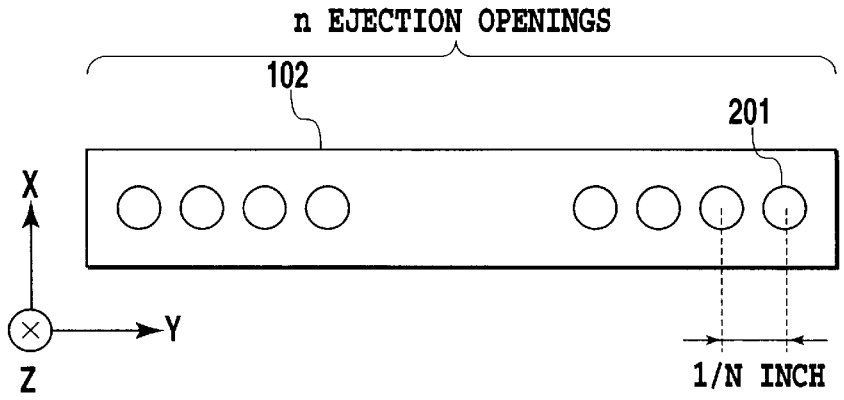
FIG. 2 is a diagram schematically showing an ejection opening row of a conventional example regarding a printing head used in the ink-jet printing apparatus.
Figure 3C:
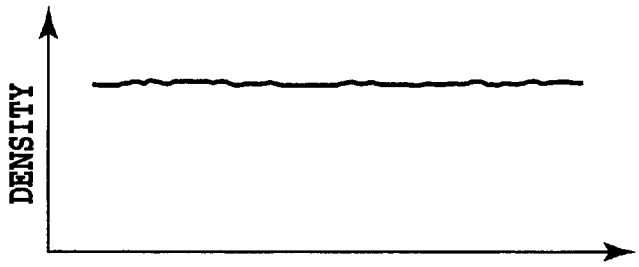
FIGS. 3A, 3B and 3C are diagrams for explaining an ideal printing state of the ink-jet printing apparatus.
Figure 3B:
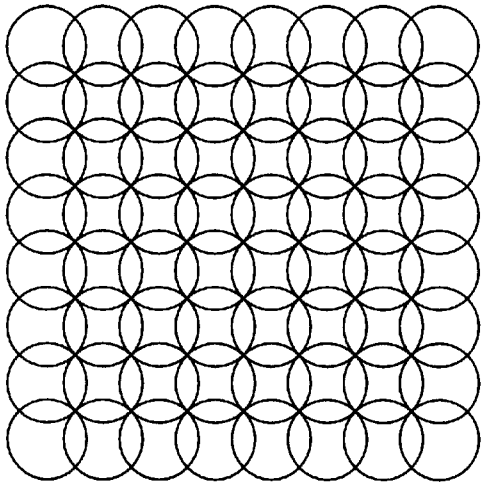
Figure 3A:
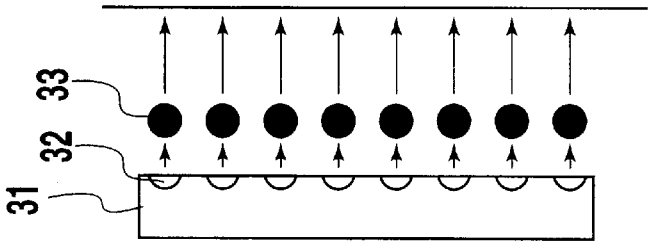
Figures 4A, 4B, 4C:
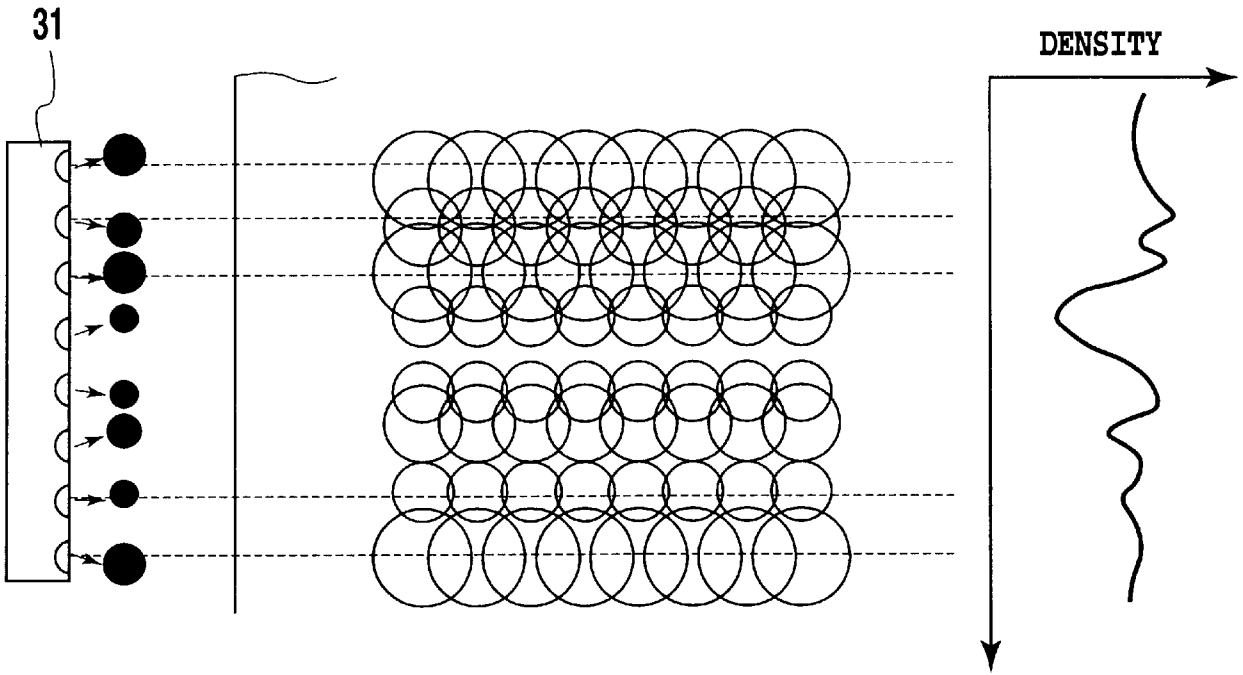
FIGS. 4A, 4B and 4C are diagrams for explaining a printing state in which unevenness of density appear in the ink-jet printing apparatus.
Figure 5C:
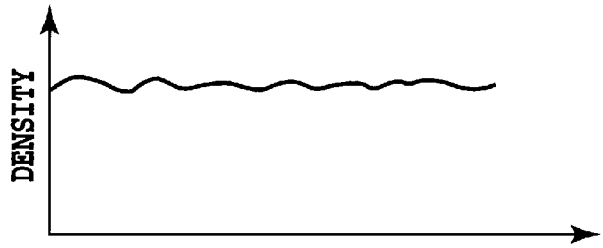
FIGS. 5A, 5B and 5C are diagrams for explaining unevenness of density that is reduced by multi-pass printing used in embodiments of the present invention.
Figure 5B:
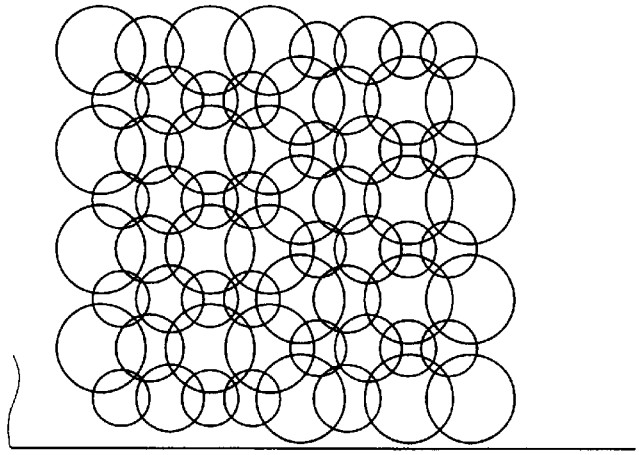
Figure 5A:
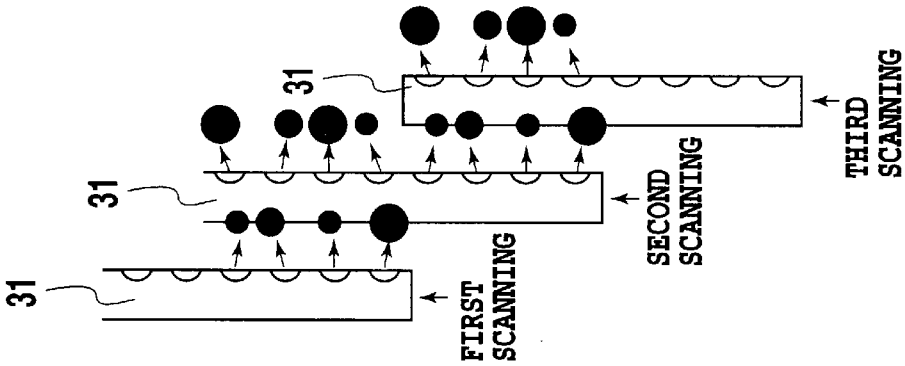
Figure 6A:
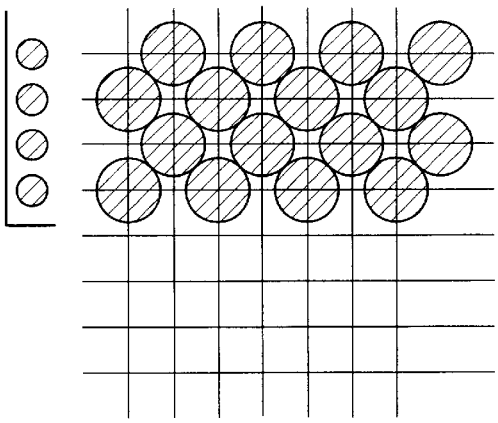
FIGS. 6A, 6B and 6C are diagrams for explaining the multi-pass printing.
Figure 6B:
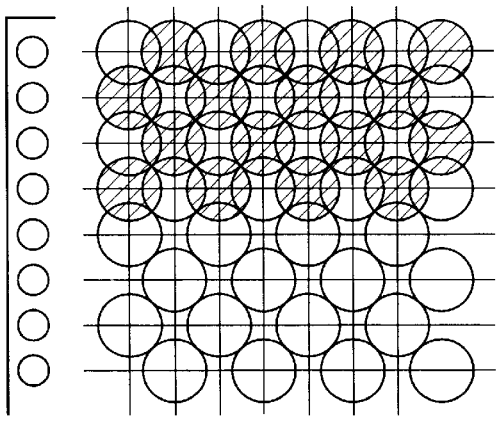
Figure 6C:
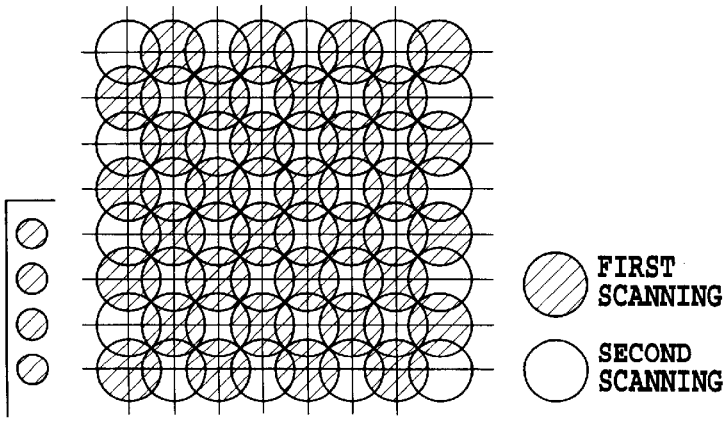
Figure 7:
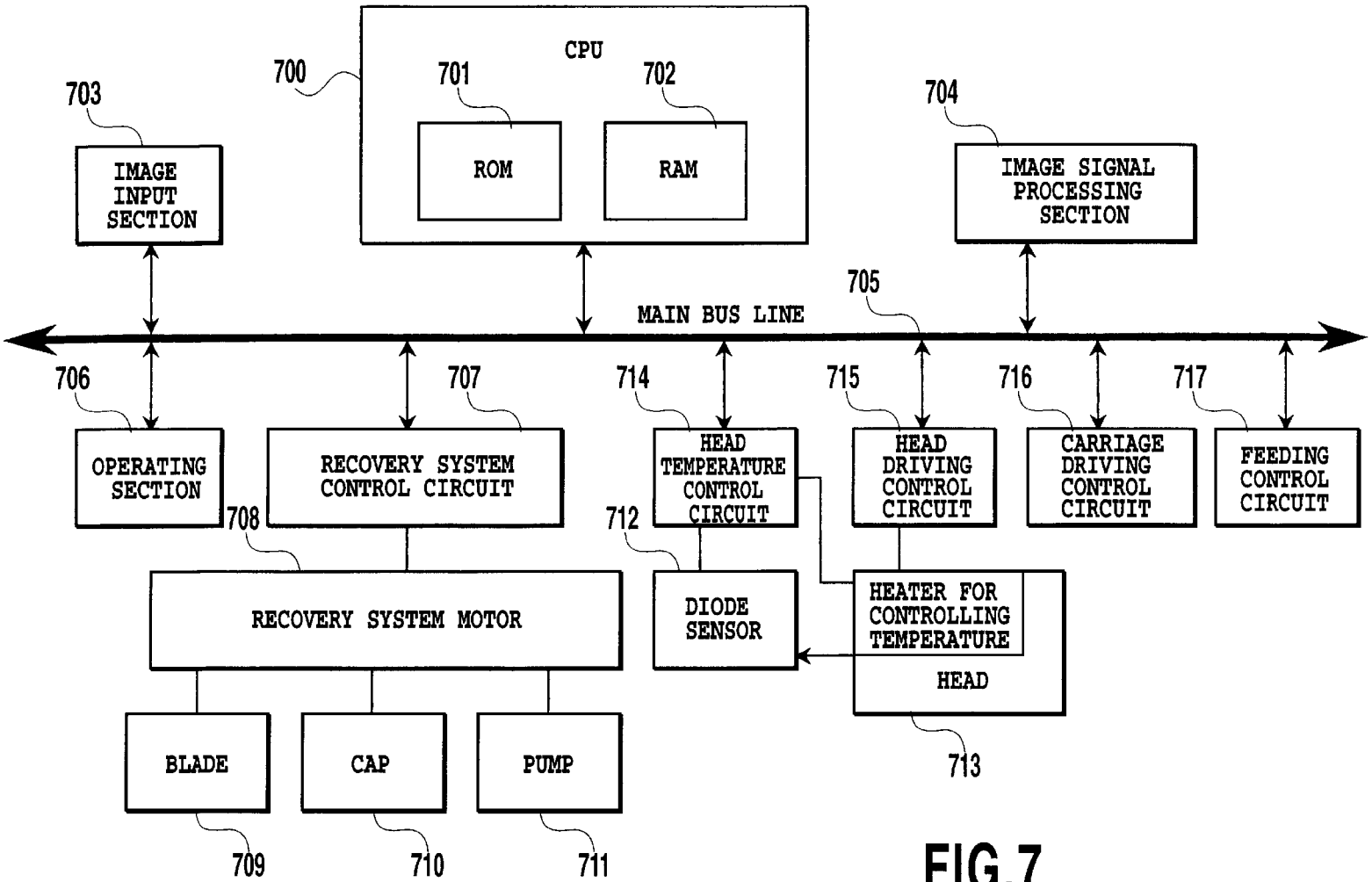
FIG. 7 is a block diagram showing a control configuration of the ink-jet printing apparatus of FIG. 1.
Figure 8:
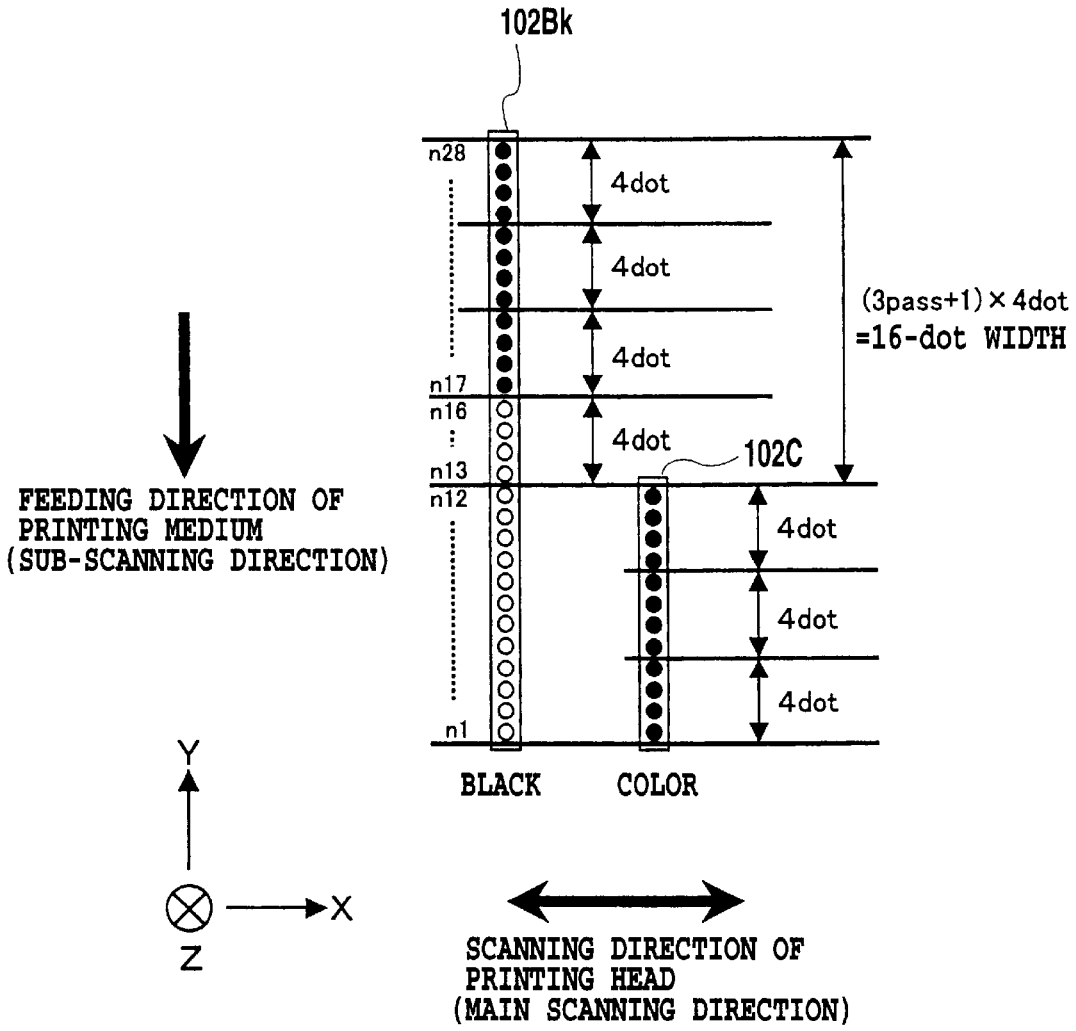
FIG. 8 is a schematic diagram showing ejection opening rows in an example in which printing heads for black ink and color ink of a first embodiment are provided separately.

FIG. 7 is a block diagram showing a control configuration of an ink-jet printing apparatus according to one embodiment of the present invention. Here, the ink-jet printing apparatus of the present embodiment is identical in mechanical structure to that shown FIG. 1. However, as shown in FIG. 8 and other drawings, the following embodiments are different from the above conventional configuration in the arrangement of printing heads, particularly the arrangement of ejection openings.

As shown in FIG. 7, the control configuration of the present embodiment is broadly divided into a software processing configuration, which includes an image input section 703, an image signal processing section 704 corresponding to the input section, and a CPU (central processing unit) 700, each accessing a main bus line 705, and a hardware processing configuration, which includes an operating section 706, a recovery control circuit 707, an ink-jet head temperature control circuit 714, a head driving control circuit 715, a driving control circuit 716 for the carriage 106, and a control circuit 717 for controlling driving of a roller 104 for feeding sheets.

In this configuration, the CPU 700 entirely controls the ink-jet printing apparatus by using a ROM 701 and a random memory (RAM) 702. More specifically, in accordance with processing programs stored in the ROM 701, the CPU 700 controls the driving of printing heads of the embodiments, which will be explained in detail later, and controls the accompanied feeding of the printing sheet.

And then, the RAM 702 is used as a work area of a controlling operation by the CPU 700. Further, the CPU 700 performs predetermined image processing on inputted image information for control of the driving of the printing heads, and the CPU 700 controls the ejection of a printing head 713 via the head driving control circuit 715 based on printing data obtained by the processing.

Further, the RAM 702 stores, for example, a program for implementing a head recovery timing chart, and supplies as necessary a recovering condition such as a preliminary ejecting condition to the recovery circuit 707, the printing head, an insulation heater, and so on. The recovery motor 708 drives the printing head 713 (102), a cleaning blade 709, which is opposed away from the printing head, a cap 710, and a suction pump 711.

As described above, the head driving control circuit 715 drives an electro-thermal converter for ejecting ink of the printing head 713 based on printing data under the control of the CPU 700. Moreover, the head driving control circuit 715 switches a usage range of the ejection openings on the printing head for black ink according to the instruction of the CPU 700. To be specific, in a mode for printing a full-color image, in which a black image and a color image is mixed as will be shown in the following embodiments, only a part of the ejection openings are used on the black ink printing head. On the other hand, in a mode for printing text information including characters only a printing head of the black ink is used as a printing head, switching is made so as to use all the ejection openings on the printing head.

Additionally, a substrate having an electro-thermal converter for ejecting ink of the printing head 713 (102) is provided with a heater for controlling temperature. The head temperature control circuit 714 can control, depending on a temperature detected by a diode sensor 712, a temperature of ink to be adjusted to a desired temperature in the printing head. Also, the diode sensor 712 is also provided on the substrate for measuring an actual temperature of ink in the printing head. The diode sensor 712 may be provided on the outside, not on the substrate, or may be provided around the printing head.

Embodiments of the present invention based on the above configuration will be explained below.

First Embodiment

FIG. 8 is a diagram showing printing heads according to the first embodiment of the present invention. A first printing head (hereinafter, also referred to as a black head) 102Bk of the present embodiment for ejecting black ink has n=28 ejection openings arranged in a sub-scanning direction, which is a direction of feeding the printing medium, at a density of N=600 per inch (600 dpi). As compared with this, printing heads 102C (hereinafter, referred to as color heads and referred to as a single printing head 102C representing the heads) respectively ejecting ink of cyan (C), magenta (M) and yellow (Y) have n=12 ejection openings arranged similarly in the sub-scanning direction at a density of N=600 per inch (600 dpi). And then, the color head 102C is installed on the printing apparatus such that 12 ejection openings n1 to n12 are disposed on the same positions as 12 ejection openings n1 to n12 of the black head 102Bk in a sub-scanning direction. Therefore, other ejection openings n13 to n28 of the black head 102Bk do not overlap the ejection openings of the color head 102C. Further, the black head and the color head, and respective the color heads are disposed at predetermined intervals in a main scanning direction.

In the present embodiment, in a full-color printing mode for printing an image having a black image and a color image mixed therein, the 12 ejection openings n17 to n28 are used for printing of the black head 102Bk. On the other hand, the color head 102C uses all of the 12 ejection openings n1 to n12. Further, in a mode for printing text and the like consisting of black characters and the like, only the black head 102Bk is used and all of the ejection openings n1 to n28 are used at printing.

Figure 9:
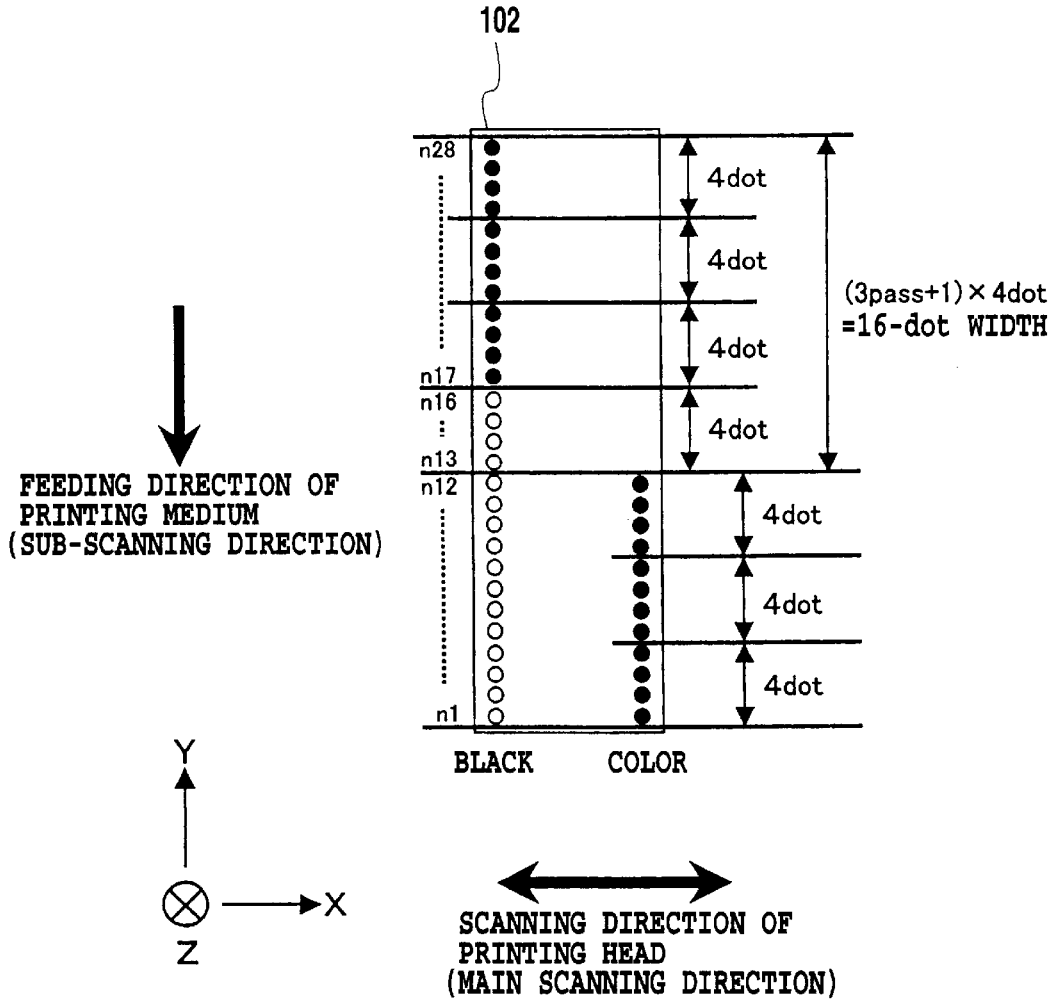
FIG. 9 is a schematic diagram showing ejection opening rows in an example in which printing heads for black ink and color ink of the first embodiment are provided integrally.
Figures 10A, 10B:
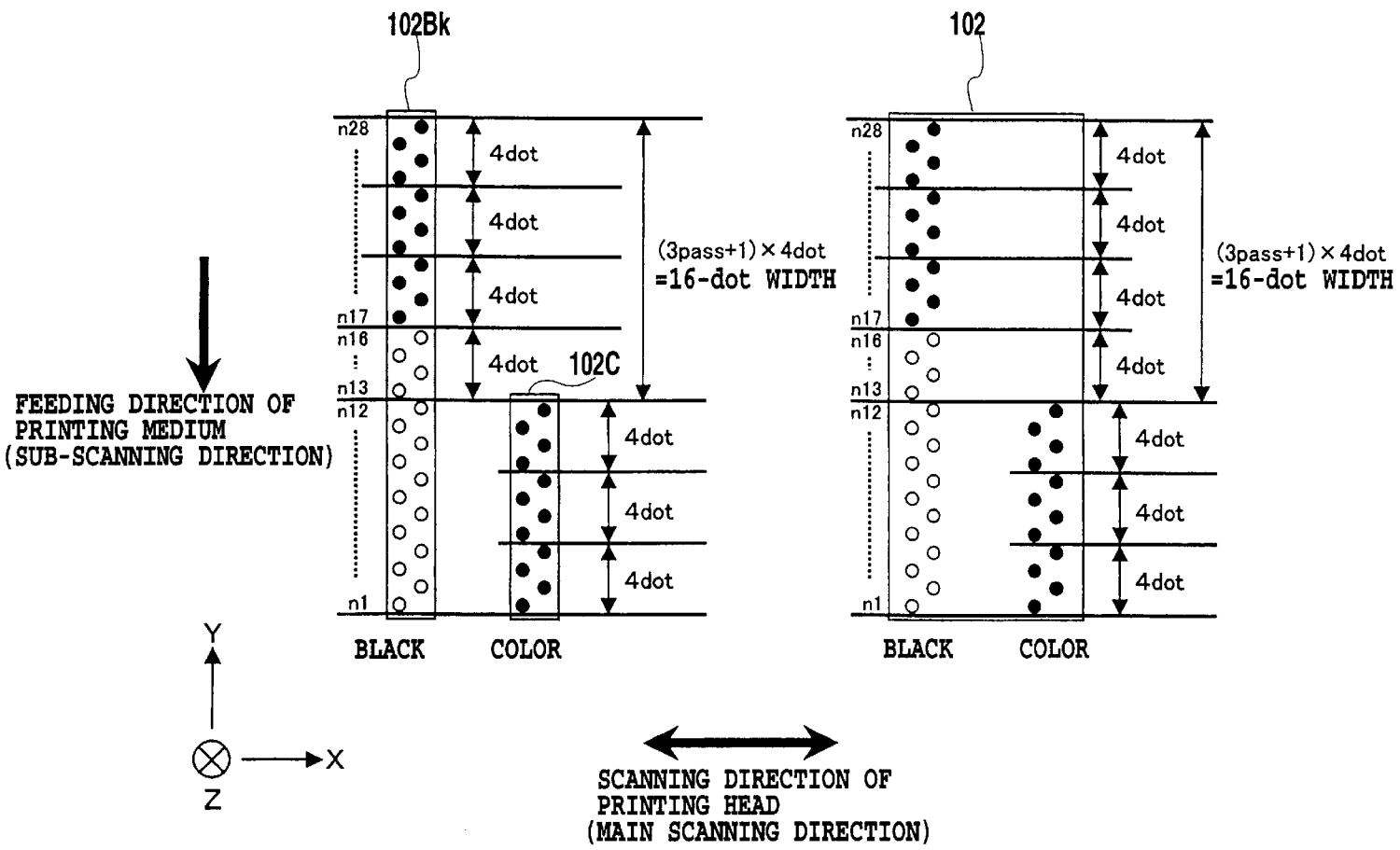
FIGS. 10A and 10B are schematic diagrams showing ejection opening rows in respective examples in which the ejection openings of the integral form and the separate forms are arranged in checkered patterns.

Beside, the printing head for ejecting black ink and the printing head for ejecting color ink may be formed as an integrated printing head as shown in FIG. 9. In other words, the printing head may be formed such that an ejection opening row of black ink is integrated with an ejection opening row of color ink. Further, as shown in a separate form of FIG. 10A and an integral form of FIG. 10B, the ejection openings may be arranged in a checkered pattern instead of in one row. In this case, a driving signal is provided at timing when a prior group of ejection openings in scanning of the printing head is faster than a subsequent group of ejection openings by d/v [second]. In other words, d [inch] is a distance between the odd-numbered group of ejection openings and an even-numbered group of ejection openings, and v [inch/second] is a main scanning speed of the printing head.

Also, permeability of the black ink used in the present embodiment has a Ka value of 1.0[$ml \cdot m^{-2} \cdot msec^{-1/2}$]. A Ka value is an index of a permeating speed measured by Bristow process. Further, a Ka value of color ink is 7.0 [$ml \cdot m^{-2} \cdot msec^{-1/2}$]. Namely, the black ink of the present embodiment is lower in permeation property than color ink.

Referring to FIGS. 11A to 11C and FIG. 12, a printing method of the present embodiment will be explained.

Figure 11A:
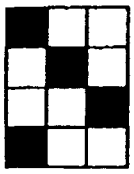
FIGS. 11A–11C are diagrams schematically showing patterns of thinning data used in the multi-pass printing.
Figure 11B:
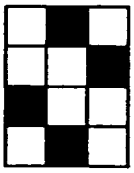
Figure 11C:
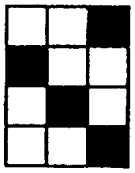
Figure 12:
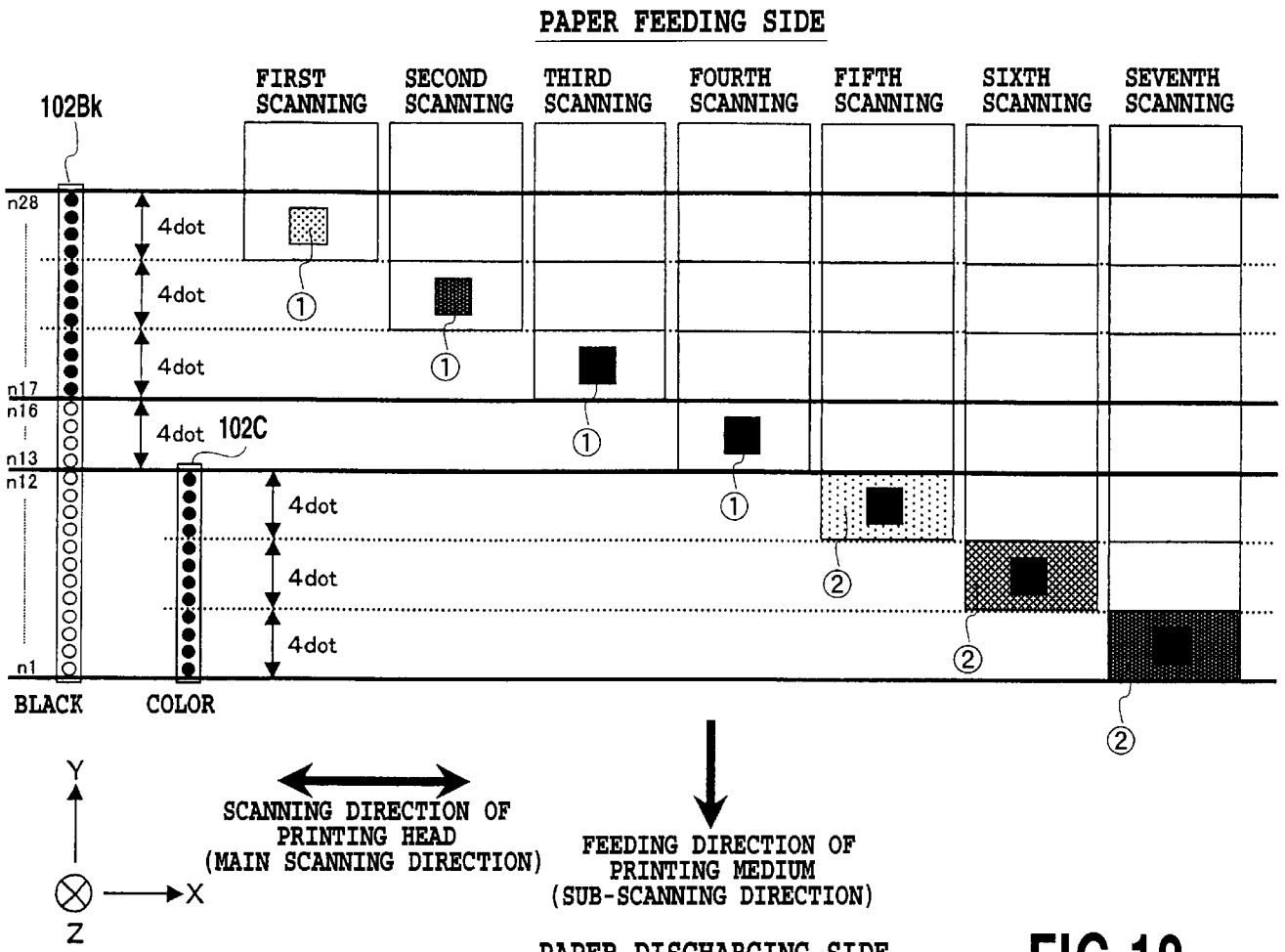
FIG. 12 is a diagram for explaining a printing method according to the first embodiment of the present invention.

FIGS. 11A to 11C show three kinds of thinning patterns being complementary to one another. Moreover, FIG. 12 is a diagram for explaining the multi-pass printing in a full-color printing mode, in which an image having a color image and a black image mixed therein is recorded using the printing heads of the present embodiment.

In referring to FIG. 12, in the first scanning, four ejection openings n25 to n28 are used, which are the 25th to 28th ejection openings from an opposite end ejection opening of ejection opening row to the printing medium feeding side (similarly below), out of 12 ejection openings set to be used for ejection in the black head 102Bk, and an image ① is printed on a corresponding scanning area based on printing data, which is thinned out by the thinning pattern shown in FIG. 11A.

Subsequently, a printing medium is fed by a distance corresponding to four ejection openings/600 dpi in a sub-scanning direction. In the subsequent second scanning, four ejection openings n21 to n24 of the 21st to 24th in the black head 102Bk are used. The same scanning area as the first scanning is scanned and the image ① is printed based on printing data, which is thinned out by the thinning pattern shown in FIG. 11B. Additionally, at this scanning of the printing head, the four ejection openings n25 to n28, which are the 25th to 28th and are previously used for printing the image ① in the first scanning, are used for printing a black image (in the case that black image data exists) on the corresponding scanning area based on printing data, which is thinned out by the thinning pattern shown in FIG. 11A.

Besides, in the present specification, a distance or a length equivalent to "a" ejection openings (or dots)/"b" dpi refers to a distance or a length of "a" times a pitch of ejection openings arranged with a density of "b" dpi, regarding a feeding amount of the printing medium.

And then, as in the previous feeding, the printing medium is fed by four ejection openings/600 dpi. In the subsequent third scanning, four ejection openings n17 to n20 of the 17th to 20th in the black head 102Bk are used, a corresponding area is scanned using the thinning pattern shown in FIG. 11C to print the image ①, and printing on the area is completed. At this scanning as well, the four ejection openings n21 to n24 of the 21st to 24th use the thinning pattern of FIG. 11B and the four ejection openings n25 to n28 of the 25th to 28th use the thinning pattern of FIG. 11A to perform printing on the respective corresponding areas.

After printing of the image ① is completed by the above-mentioned three scanning, the printing medium is further fed by four ejection openings/600 dpi in a similar manner. And then, the fourth scanning is performed. In this scanning, four ejection openings n13 to n16 of the black head correspond to a scanning area in which the image ① has been already printed. Since these ejection openings are not set to be used for printing, this scanning area is not printed. In other words, in the present embodiment, the ejection openings of the printing heads for black ink and color ink are arranged such that printing of a single scanning is not performed between printing of a black image and printing of a color image. Hence, it is possible to provide time for sufficiently fixing black ink. As a result, it is possible to reduce bleeding in colors that may appear at a boundary between the black image and the color image to be subsequently printed on the same area on which the black image has been already printed.

Additionally, in the fourth scanning, even in the case of the above scanning in which a black image ① is not printed on the scanning area, the 12 ejection openings n17 to n28, which are set to be used for ejection in the black head are used for printing on the respective corresponding scanning areas as described above by using the corresponding thinning patterns of FIGS. 11A to 11C, similarly to the scanning mentioned above.

Upon completion of the above four times of scanning, the printing medium is fed in a like manner by four ejection openings/600 dpi, and printing is performed for the fifth scanning. In printing of the fifth scanning, out of 12 ejection openings in the color head 102C, four ejection openings n9 to n12 of the 9th to 12th are used, scanning is performed on the scanning area having a black image ① based on printing data thinned out by the thinning pattern shown in FIG. 11A, and a color image ② is printed on an area adjacent to the black image ①. As described above, since black ink has been substantially fixed at this printing, occurrence of bleeding can be reduced between a black image and a color image, which are adjacent to each other.

Additionally, in the above scanning, out of the ejection openings of the black ink head 102Bk, the ejection openings n9 to n12 disposed on the same positions as the ejection openings n9 to n12 of the color head are not set for printing. Thus, it is a matter of course that black ink is not ejected onto the scanning area of the image ②. Further, out of the ejection openings of the black head 102Bk, the 12 ejection openings n17 to n28 set to be used for printing are used for printing on the respective corresponding scanning areas as described above by using the corresponding thinning patterns of FIGS. 11A to 11C, and subsequent scanning is performed similarly.

Subsequently, after the printing medium is fed by four ejection openings/600 dpi, in the sixth scanning, four ejection openings n5 to n8 of the 5th to 8th in the color head 102C are used to print the image ② based on printing data thinned out by the thinning pattern of FIG. 11B. At this scanning, four ejection openings of the 9th to 12th in the color head 102C are used for printing on a corresponding scanning area based on printing data thinned out by the thinning pattern of FIG. 11A.

Furthermore, in the seventh scanning after the printing medium is fed by four ejection openings/600 dpi, printing of the image ② is completed by using four ejection openings n1 to n4 of the 1st to 4th in the color head 102C based on printing data thinned out by the thinning pattern of FIG. 11C. In this scanning operation, in a like manner, four ejection openings of the 5th to 8th using the thinning pattern of FIG. 11B, and four ejection openings of the 9th to 12th using the thinning pattern of FIG. 11A are used for printing on the respective corresponding areas based on respective printing data.

The above-mentioned printing method is generalized as follows: when an amount of one time of feeding the printing medium is L (equivalent to four ejection openings/600 dpi) and the number of times of scanning required for completing a black image is m (three times), the printing method uses a printing head in which a first ejection opening row (n17 to n28), which are set to be used in the black head 102Bk, and a second ejection opening row (n1 to n12), which are set to be used in the color head, and the first and second ejection opening rows are parted from each other at a distance corresponding to (m+1)×L ejection openings/N dpi (in the head configuration shown in FIGS. 8 to 10 of the present embodiment, the distance is equivalent to (3+1)×four ejection openings/600 dpi=16 ejection openings/600 dpi), the distance being measured as that between respective ejection openings located at printing medium feed side ends. This method can provide time corresponding to one time of scanning for fixing black ink as described above in printing by the multi-pass printing method, thereby suitably reducing bleeding in colors (between black and color). Particularly in the present embodiment, black ink having a lower Ka value measured by Bristow process, that is, a low permeating speed, is ejected to the printing medium and is printed prior to color ink having a higher Ka value measured by Bristow process, that is, a higher permeating speed. Thus, it is possible to improve permeability and fixing on the printing medium as well as to reduce bleeding in colors.

Figure 13:
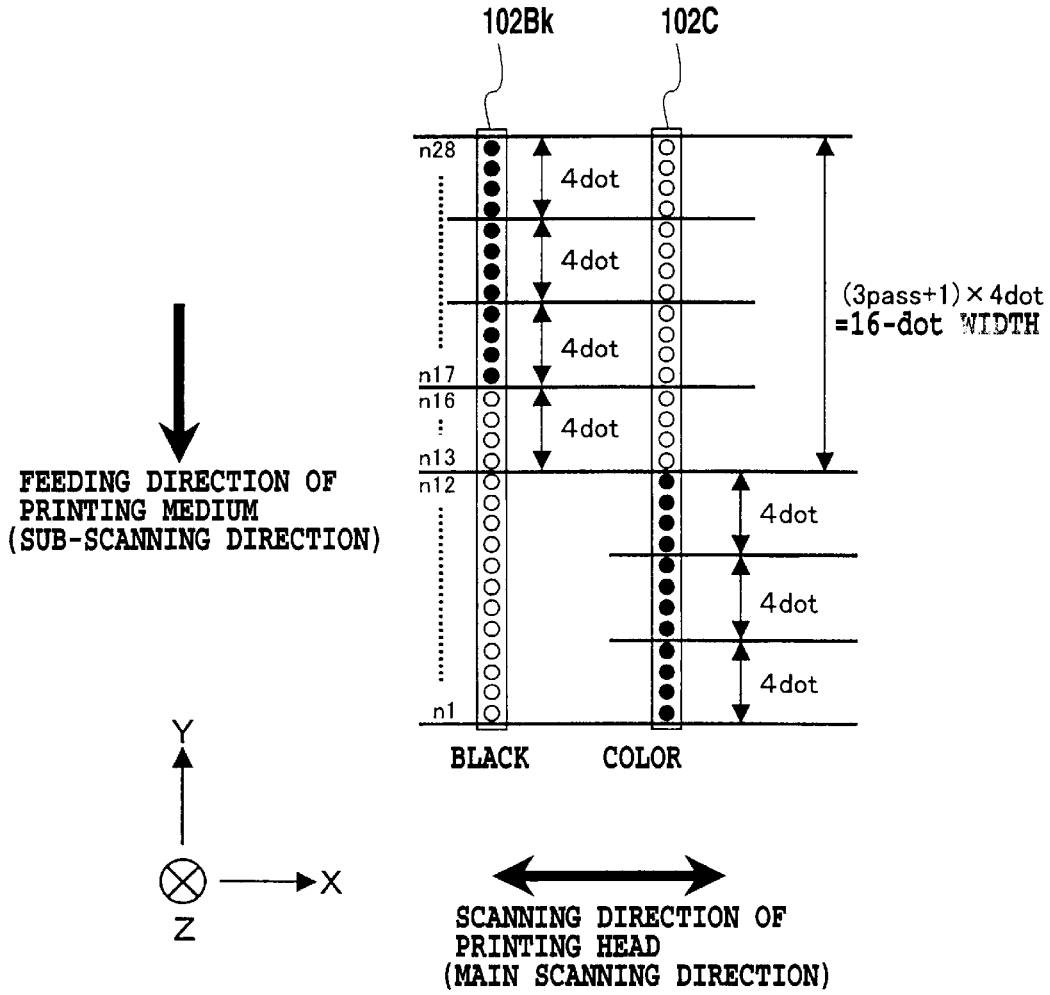
FIG. 13 is a schematic diagram showing another example of the arrangement of ejection openings on a printing head applicable to the first embodiment of the present invention.

Additionally, in the present embodiment, fixed patterns shown in FIGS. 11A to 11C serve as thinning patterns. For example, a random thinning pattern may be also applicable to prevent synchronization with image data. Also, different thinning patterns may be respectively used for each printing head. Further, in the present embodiment, the second ejection opening row for ejecting color ink has 12 ejection openings, and all of the ejection openings are used. The printing head may have more ejection openings. For example, as shown in FIG. 13, the color ink head may have the same number of ejection openings as the black head, and the second ejection opening row set to be used for printing may have 12 ejection openings of n1 to n12. Likewise, although the black head has 28 ejection openings in the above embodiment, more or fewer ejection openings may be applicable and the first ejection opening row set for use may have 12 ejection openings.

Moreover, as described in the above generalization, in the present embodiment, the second ejection opening row for ejecting color ink is parted from the first ejection opening row for ejecting black ink toward a printing medium discharge side at the distance of (m+1)×L=(3+1)×4 ejection openings/600 dpi=16 ejection openings/600 dpi, which is measured as that between respective ejection openings located at a printing paper feed side ends, in the case that an amount L of one time of feeding the printing medium is 4 ejection openings/600 dpi and the number m of times of scanning for completing an image by means of the first printing head for ejecting black ink is 3 times. The present invention is not limited to the above distance.

Figure 14:
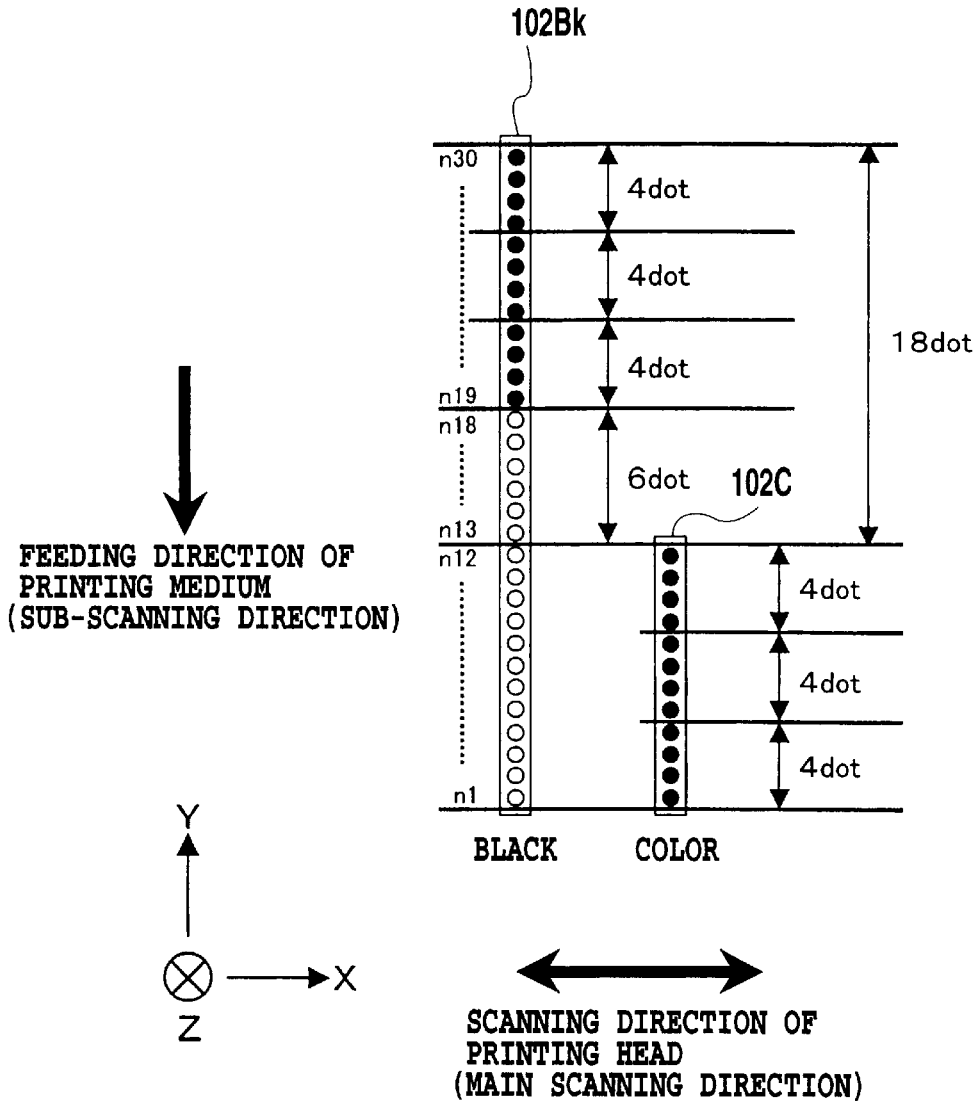
FIG. 14 is a schematic diagram showing still another example of the arrangement of ejection openings on a printing head applicable to the first embodiment of the present invention.

For example, as shown in FIG. 14, the first ejection opening row for ejecting black ink may have 30 ejection openings and then the distance may be a length of 18 ejection openings/600 dpi which is longer than a length of (m+1)×L=16 ejection openings/600 dpi and is shorter than (m+2)×L=20 ejection openings/600 dpi. In this case, relative to an image completed by the ejection openings of n27, n23 and n19 of the first ejection opening row for ejecting black ink, an end of an area printed by the ejection opening n12 in the second ejection opening row for ejecting color ink, is shifted by a distance corresponding to two ejection openings/600 dpi. Thus, some of printed images partially have a time interval of two times of scanning between printing of a black image and printing of a color image, thereby achieving a better effect of preventing bleeding between black and color.

According to the above embodiment, the above-mentioned printing control makes it possible to print a high-quality image where bleeding in colors is prevented in multi-pass printing.

Second Embodiment

Figure 15:
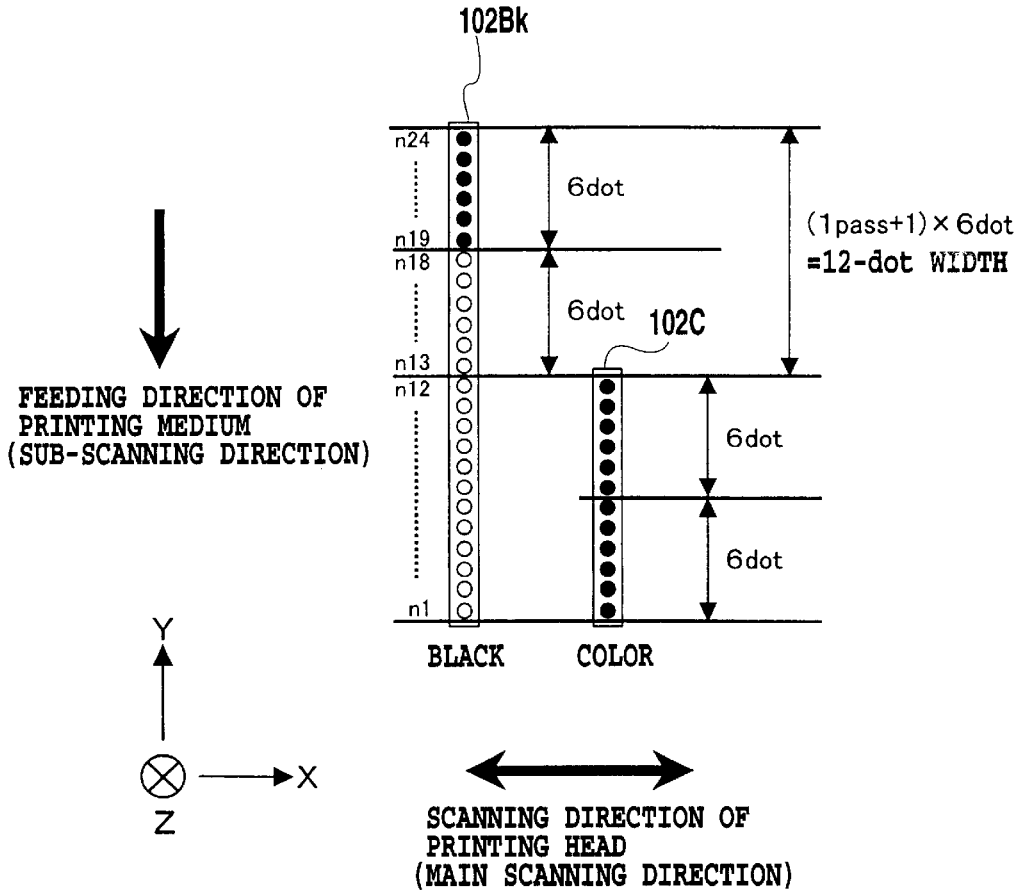
FIG. 15 is a schematic diagram showing the arrangement of the ejection openings in an example in which printing heads for black ink and color ink are provided separately according to a second embodiment of the present invention.

FIG. 15 is a diagram showing a configuration of ejection opening rows of printing heads for black ink and color ink according to a second embodiment of the present invention.

A printing head 102Bk shown in FIG. 15 for ejecting black ink arranges n=24 ejection openings at a density of N=600 per inch (600 dpi). In a full-color printing mode, only six ejection openings n19 to n24 are used among them. As compared with this, a printing head 102C for ejecting color ink arranges n=12 ejection openings at a density of N=600 per inch (600 dpi). In a full-colormode, 12 ejection openings n1 to n12 are all used. Further, a positional relation between the respective ejection openings in the printing heads is that respective ejection openings having the same ejection opening numbers coincide with each other in a sub-scanning direction, and in a main scanning direction, the respective ejection openings of the printing heads are apart from each other at a predetermined interval.

Additionally, as described in the first embodiment the black head 102Bk and the color head 102C may be formed as an integrated printing head instead of separated heads. Moreover, the ejection openings may be arranged in a checkered pattern instead of a single row. Furthermore, the number of ejection openings of the color head 102C may be the same as that of the first printing head. In addition, the present embodiment uses ink having same permeation ability as that of ink used in the first embodiment.

Figure 16A:
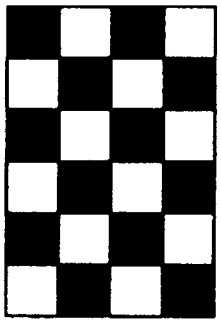
FIGS. 16A and 16B are diagrams schematically showing thinning data pattern used in the multi-pass printing according to Embodiments 2 and 3 of the present invention.
Figure 16B:
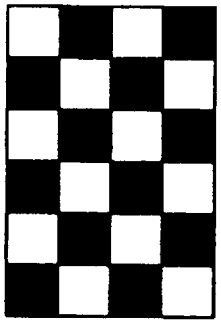
Figure 17:
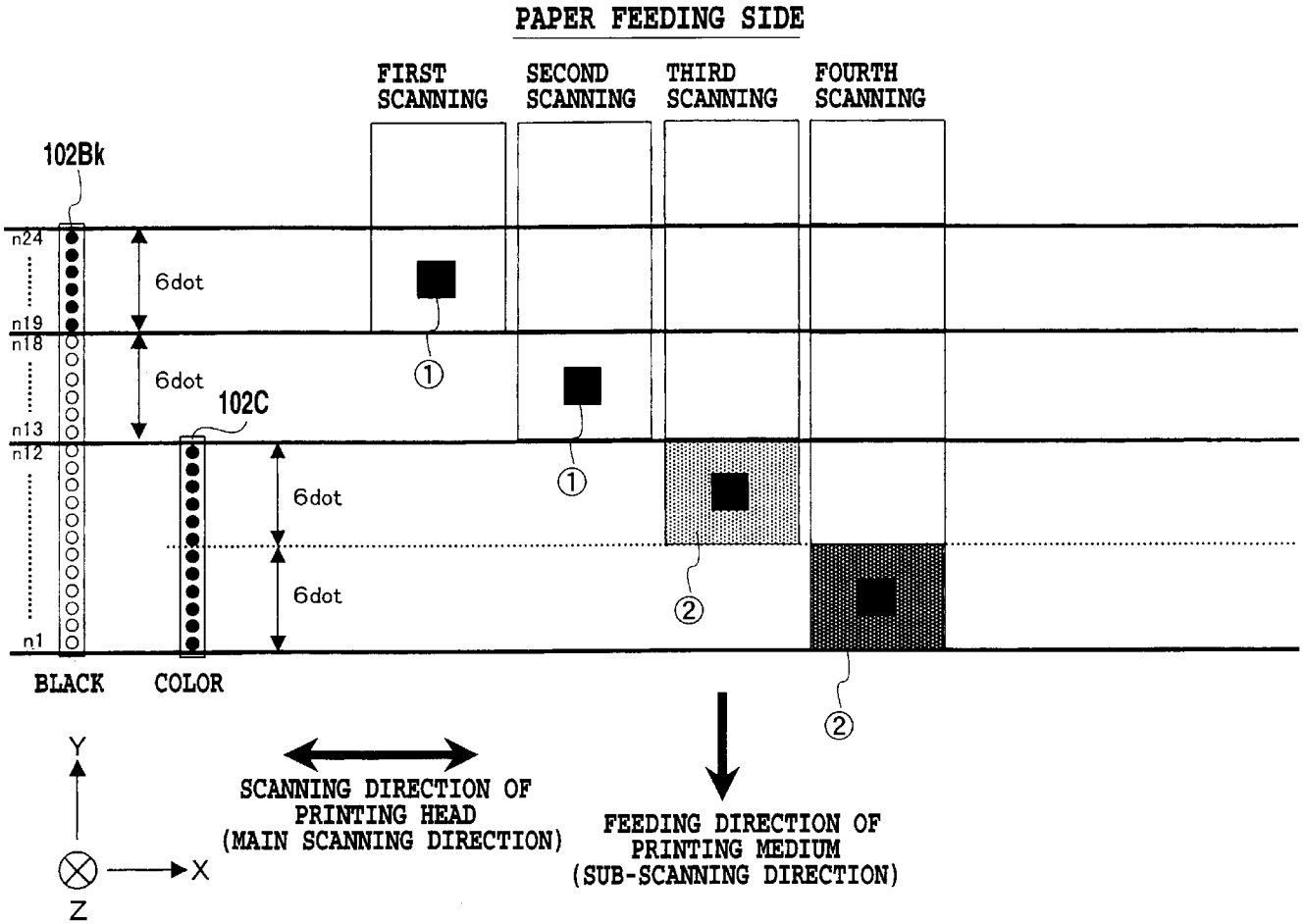
FIG. 17 is a diagram for explaining a printing method according to the second embodiment of the present invention.

Referring to FIGS. 16 and 17, the following will explain a printing method of the present embodiment. FIG. 16 is a diagram showing two kinds of thinning patterns, which are complementary to each other.

In referring to FIG. 17, at first, all the six ejection openings n19 to n24 set for use of the 19th to 24th in the black head 102Bk are used in the first scanning, a scanning area corresponding to these ejection openings is scanned by the printing heads, and an image ① is printed based on printing data. As this, the present embodiment completes printing of a black image by one time of scanning (hereinafter, referred to as one-pass printing) instead of multi-pass printing.

Subsequently, a printing medium is moved by an amount corresponding to 6 ejection openings/600 dpi in a sub-scanning direction, and then, in the second scanning, ejection openings n13 to n18 of the black head 102Bk correspond to the scanning area on which the image ① has been already printed at the first scanning. Since these ejection openings are not set for use, the black head does not perform printing on this scanning area. Additionally, in the scanning area corresponding to the ejection openings n19 to n24 of the black head 102Bk which are set for use, one-pass printing is performed by using all the six ejection openings based on the corresponding printing data, as matter of course.

Further, after the printing medium is moved by 6 ejection openings/600 dpi, in the third scan, six ejection openings n7 to n12 are used, which are the 7th to 12th counted from an ejection opening located at an opposite end to a printing medium feed side (similarly below), out of the twelve ejection openings set for use in the color head 102C, and based on printing data thinned out according to the checkered thinning pattern shown in FIG. 16A, the scanning area having the recorded image ① is scanned and a color image ② is printed. Additionally, in this scanning operation, the six ejection openings set for use of 19th to 24th in the black head 102Bk are used for one-pass printing for the corresponding area.

Moreover, after the printing medium is moved by six ejection openings/600 dpi, in the fourth scan, six ejection openings n1 to n6 of the 1st to 6th are used out of the 12 ejection openings set for use in the color head 102C. Based on printing data thinned out by the thinning pattern shown in FIG. 16B which is reverse pattern to the above mentioned checker pattern, the area on which the color image ② has been printed is scanned and the printing of the image ② is completed. In this scanning operation, the six ejection openings n7 to n12 of the 7th to 12th in the color head perform printing on the corresponding scanning area based on printing data thinned out by the checkered thinning pattern of FIG. 16A. Further, six ejection openings set for use of the 19th to 24th in the black head perform printing on the corresponding scanning area in one-pass printing.

The above-mentioned printing method is generalized as follows: when an amount of one time of moving the printing medium is L (equivalent to 6 ejection openings/600 dpi) and m (1) time of scanning is required for completing a black image by using the printing head for ejecting black ink, a first ejection opening row (n19 to n28) for ejecting black ink and a second ejection opening row (n1 to n12) for ejecting color ink are apart from each other at a distance of (m+1)×L ((1+1)×6 ejection openings/600 dpi=12 ejection openings/600 dpi), which is measured as that between respective ejecting openings located at printing medium feed side ends. Thus, it is possible to provide a time interval equivalent to one time of scanning between printing of a black image and printing of a color image, thereby improving fixing of black ink. According to above printing method, even when multi-pass printing, by which an image is completed by two scans of the printing head for ejecting color ink, is combined with one-pass printing, by which an image is completed by one time scanning of the printing head for ejecting black ink, it is possible to reduce bleeding between a black image and a color image.

Additionally, in the present embodiment, fixed checkered patterns serve as the thinning patterns. A random thinning pattern is also applicable for preventing synchronization with image data. Further, in the present embodiment, the printing head for ejecting color ink has 12 ejection openings and all the ejection openings can be used. More ejection openings may be provided, and the 12 ejection openings having the above relationship with the black head may be used for multi-pass printing. Although the printing head for ejecting black ink also has 28 ejection openings, more or fewer ejection openings may be provided. The number of ejection openings for one-pass printing may be six as mentioned above.

Further, with regard to a distance between the respective ejection openings located at printing medium feed side ends, the second ejection opening row for ejecting color ink is parted from the first ejection opening row for ejecting black ink toward a printing medium discharge side at the distance of (m+1)×L=(1+1)×6 ejection openings/600 dpi=12 ejection openings/600 dpi when an amount of one time of moving the printing medium is L=6 ejection openings/600 dpi and the number of times of scanning required for completing a black image by using the printing head for ejecting black ink is m=1. The distance is not limited to the above.

Figure 18:
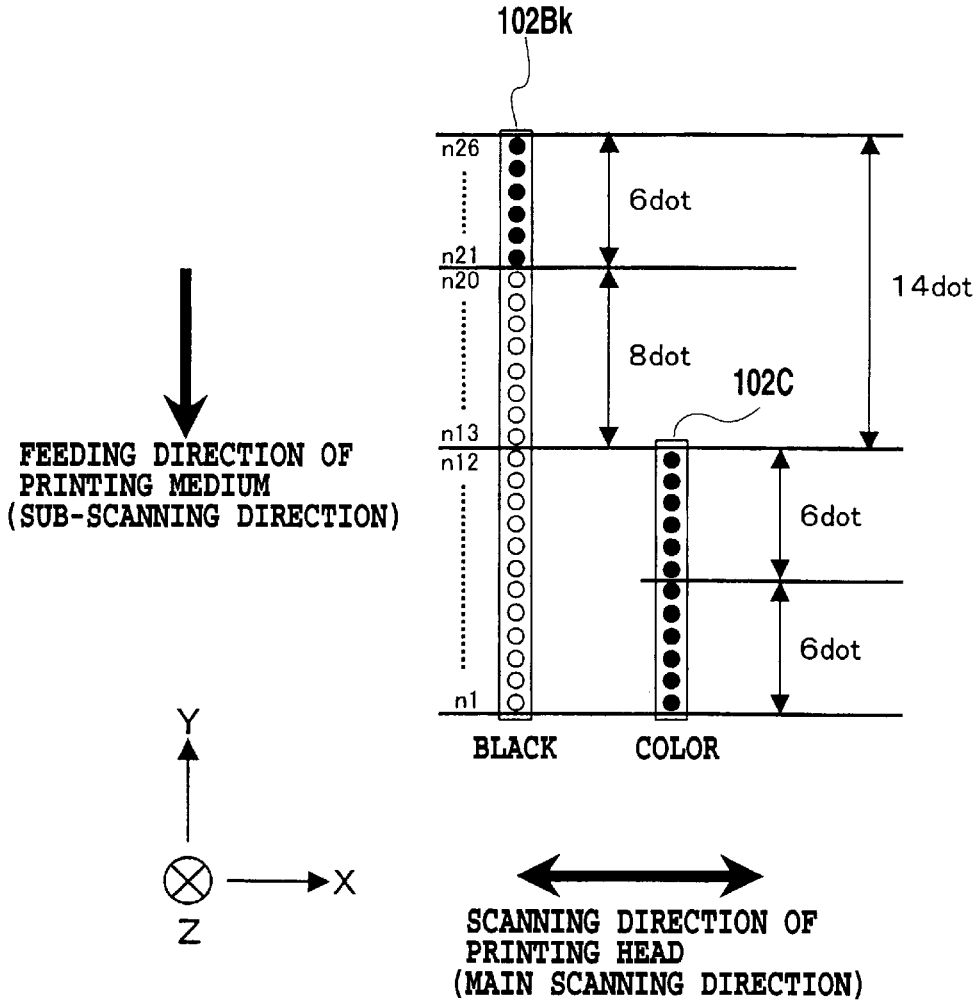
FIG. 18 is a schematic diagram showing another example of the arrangement of ejection openings on a printing head applicable to the second embodiment of the present invention.

For example, as shown in FIG. 18, the first ejection opening row for ejecting black ink may be provided with 26 ejection openings and the distance may be a length of 14 ejection openings/600 dpi, which is longer than a length of (m+1)×L=12 ejection openings/600 dpi and is shorter than a length of (m+2)×L=18 ejection openings/600 dpi. In this case, an area printed by the second ejection opening row for ejecting color ink is shifted by an amount of two ejection openings/600 dpi from an image printed by the first ejection opening row for ejecting black ink. Thus, some of printed images partially have a time interval corresponding to two times of scanning between printing of a black image and printing of a color image, thereby achieving a better effect of preventing bleeding between black and color.

In the present embodiment as well, the above-mentioned control makes it possible to print a high-quality image, in which bleeding in colors can be prevented in multi-pass printing even in combination with one-pass printing.

Third Embodiment

Figure 19:
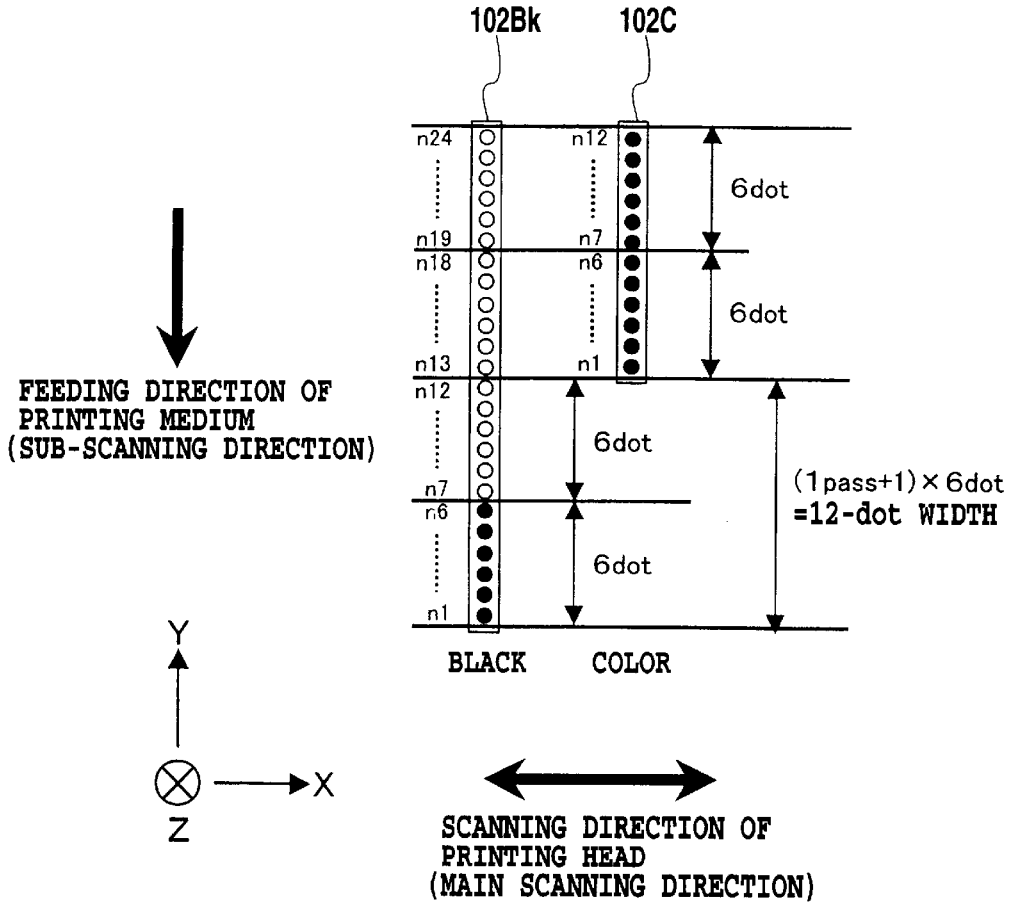
FIG. 19 is a schematic diagram showing the arrangement of ejection openings in an example in which printing heads for black ink and color ink are provided separately according to a third embodiment of the present invention.

FIG. 19 is a diagram showing the arrangement of ejection openings on printing heads for ejecting black ink and color ink according to a third embodiment of the present invention.

A black head 102Bk of the present embodiment has n=24 ejection openings arranged with a density of N=600 per inch (600 dpi). Ejection openings used for a full-color mode of the present embodiment are six ejection openings n1 to n6. Further, a color head 102C has n=12 ejection openings arranged with a density of N=600 per inch (600 dpi). In a full-color mode, twelve ejection openings n1 to n12 are all used. And then, a positional relationship between the ejection openings of the respective printing heads is that in a sub-scanning direction, the ejection openings n13 to n24 of the black head 102Bk are arranged on the same positions as the ejection openings n1 to n12 of the color head 102C. On the other hand, in a main scanning direction, the ejection openings of the respective printing heads are disposed at a predetermined interval. Additionally, as described in the first embodiment, the black head and the color head may be formed as an integrated printing head instead of separated heads. Moreover, the ejection openings may be arranged in a checkered pattern instead of a single row. Furthermore, the number of ejection openings of the color head may be the same as that of the black head. Further, unlike ink used in the first embodiment, the present embodiment uses color ink lower in permeation ability than that of black ink.

Figure 20:
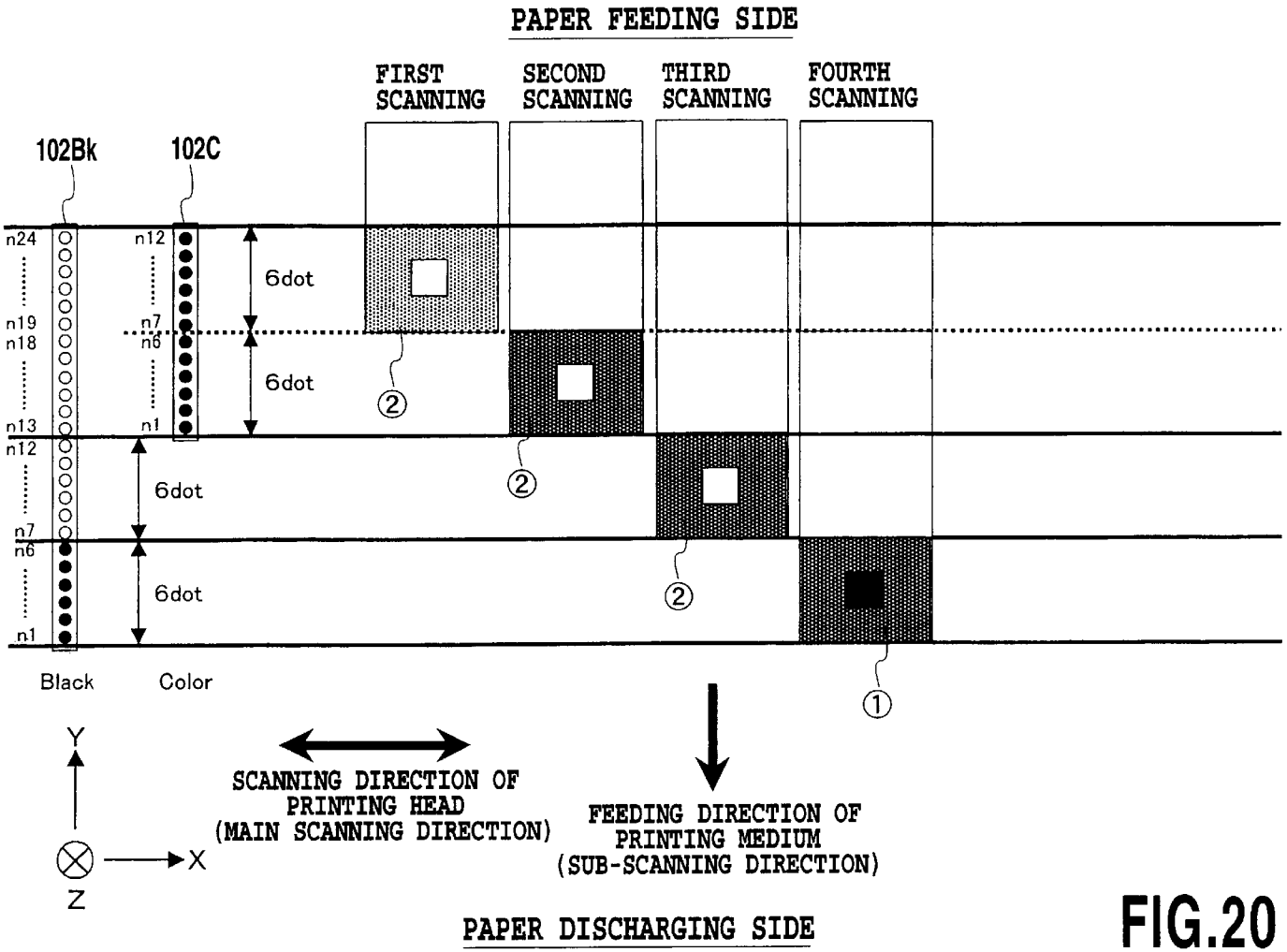
FIG. 20 is a diagram for explaining a printing method according to the third embodiment of the present invention.

Referring to FIGS. 16 and 20, the following will explain a printing method in a full-color mode of the present embodiment.

In FIG. 20, first, six ejection openings n7 to n12 of the 7th to 12th are used out of 12 ejection openings of the color head 102C that are set for use in the first scanning. Based on printing data thinned out by the thinning pattern of the checker pattern shown in FIG. 16A, a corresponding scanning area is scanned to be printed for a color image ②.

Subsequently, after the printing medium is moved by 6 ejection openings/600 dpi in a sub-scanning direction, in the second scan, six ejection openings of the 1st to 6th are used out of the 12 ejection openings set for use in the color head 102C. Based on printing data thinned out by the thinning pattern with a checkered pattern shown in FIG. 16B, which is a reverse pattern to the above mentioned pattern, a corresponding scanning area is scanned to be complete printing of the color image ②. Additionally, at this moment, six ejection openings n7 to n12 of the 7th to 12th are used for printing on the corresponding scanning area based on printing data thinned out by the checkered thinning pattern of FIG. 16A.

Furthermore, in the third scanning after the printing medium is moved by an amount of 6 ejection openings/600 dpi, the ejection openings n7 to n12 of the black head 102Bk correspond to the scanning area where the image ② has been printed. Since these ejection openings are not set for use, printing is not performed on this scanning area. In other scanning areas, printing is performed on the scanning areas by using the 12 ejection openings of the color head 102C.

Furthermore, in the fourth scanning after the printing medium is moved by 6 ejection openings/600 dpi, six ejection openings n1 to n6 are all used, which are set for use of the 1st to 6th in the black head 102Bk. A corresponding scanning area is scanned, and a black image ① is printed by one-pass printing. On the other hand, all of the 12 ejection openings of the color head 102C are used for printing on the corresponding scanning areas based on printing data thinned out by the thinning pattern.

As described above, in the present embodiment, when an amount of one time of moving the printing medium is L=6 ejection openings/600 dpi and the number of times of scanning required for completing an image by the printing head for ejecting black ink is m=1 time, the first ejection opening row for ejecting black ink and the second ejection opening row for ejecting color ink are apart from each other with a distance of $(m+1)\times L=(1+1)\times 6$ ejection openings/600 dpi=12 ejection openings/600 dpi, which is measure as a distance between respective ejection openings located at printing medium discharge side ends. Hence, even when an image is completed by the black head after the image is completed by multi-pass printing using the color head, it is possible to reduce bleeding in colors that is peculiar to multi-pass printing.

Additionally, in the present embodiment, the thinning pattern is a fixed and is a checkered pattern. A random thinning pattern is also applicable for preventing synchronization with image data. Also, the present embodiment uses all of the 12 ejection openings of the printing head for ejecting color ink. More ejection openings may be provided and the 12 ejection openings may be used for multi-pass printing. Although the printing head for ejecting black ink has 28 ejection openings, more or fewer ejection openings may be provided and the six ejection openings may be used for one-pass printing.

Further, in the present embodiment, when an amount of one time of moving the printing medium is L=6 ejection openings/600 dpi and the number of scanning required for completing an image by the printing head for ejecting black ink is m=1 time, the first ejection opening row for ejecting black ink and the second ejection opening row for ejecting color ink are apart from each other at a distance of $(m+1)\times L=(1+1)\times 6$ ejection openings/600 dpi=12 ejection openings/600 dpi, which is measured as a distance between respective ejection openings located at the paper discharge side ends. As matter of course, the distance is not limited to this.

Figure 21:
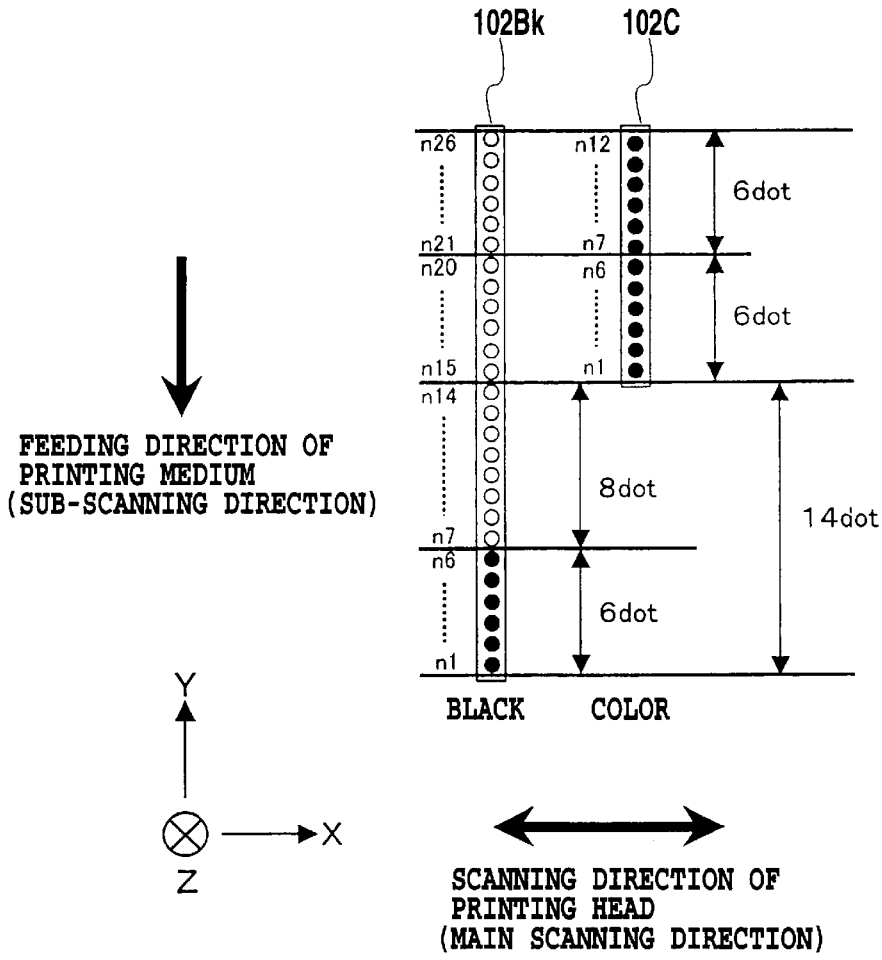
FIG. 21 is a schematic diagram showing another example of the arrangement of ejection openings on a printing head applicable to the third embodiment of the present invention.

For example, as shown in FIG. 21, when the first ejection opening row for ejecting black ink has 26 ejection openings and the distance between the two ejection opening rows may be 14 ejection openings/600 dpi, which is longer than $(m+1)\times L$=12 ejection openings/600 dpi and is shorter than $(m+2)\times L$=18 ejection openings/600 dpi. In this case, an end of image completed by using the ejection openings n7 and n1 of the printing head for ejecting color ink is shifted by an amount of 2 ejection openings/600 dpi from an end of image printed by the ejection opening n6 of the printing head for ejecting black ink. Thus, it is possible to achieve a better effect of preventing bleeding between black and color.

In the present embodiment, even when an image is completed by the black head after the image is previously completed by the color head, the above-mentioned control makes it possible to record a high-quality image in which bleeding in colors can be prevented in multi-pass printing.

Additionally, according to the above first and second embodiments, when full color printing is carried out, in view of permeation ability of black ink and color ink, printing of black ink, which is relatively low in permeation ability, is performed prior to printing of color ink, which is higher than black ink in permeation. However, as described in the third embodiment, printing of color ink may be previously performed. In this case, it is desirable that permeation ability of the respective inks be within acceptable ranges of image quality such as bleeding. Further, regarding the arrangement of the ejection openings when printing of color ink is performed first, a configuration completely reversed from those of the first and second embodiments may be applicable. In other words, the ejection opening row of color ink may be provided for black ink, and the ejection opening row of black ink may be provided for color ink.

Moreover, in the above embodiments, one time of scanning is provided or two times of scanning are partially provided for fixing time between printing of a black image and printing of a color image. As matter of course, the number of times of scanning is not limited to the above. When a black image and a color image are printed by multi-pass printing, the number of times of scanning for effectively reducing bleeding in colors depends upon used ink and a printing medium. Hence, the number of times of scanning may be determined in view of these factors. Therefore, two or more times of scanning may be provided between printing of a black image and printing of a color image. However, in consideration of a throughput of the printing apparatus and a length determined by the number of ejection openings of the printing head, and so on, the above-mentioned embodiments are preferable.

Furthermore, the above-mentioned embodiments do not particularly discuss at which of go and return scanning of the printing head printing with color ink and black ink is performed. The above-mentioned embodiments can practice any of the following forms.

In a first form, printing is performed both in a go scanning and a return scanning. In this case, in the example shown in FIG. 12 of the first embodiment, the first, third, fifth, and seventh scanning of FIG. 12 are the go scanning, and the second, fourth, and sixth scanning are the return scanning. In this form, a printing time can be entirely shortened.

In a second form, printing is performed in any one of the go scanning and the return scanning. In the example of FIG. 12, all of the first to seventh scans are, for example, the go scanning. In this form, particularly color inks including magenta, yellow, and cyan inks can be always constant in overlapping manner. More specifically, in the case of printing of reciprocating scanning (printing at both go and return scanning), the overlapping of ink differs between go and return scanning due to the arrangement of ejection opening rows of the above three kinds of ink, and then tones of printed colors may be different. In contrast, the present form allows overlapping of inks to be constant and tones of the printed colors to be always constant. Further, in this case, time for the fourth scanning in the example of FIG. 12, when the time is converted to time for go and return scanning, is twice longer than that of the above mentioned first form. Hence, it is possible to increase time for fixing black ink previously ejected for printing.

In the third form, a scanning direction of printing performed by the first ejection opening row (black ink) is opposite to a scanning direction of printing performed by the second ejection opening row (color ink). In the example of FIG. 12, for example, the first to fourth scanning are the go scanning, and the fifth scanning to seventh scanning are the return scanning. According to this form, regarding each of the ejection opening rows of black ink and color ink, it is possible to reduce the number of elements driven in one time of scanning and achieve smaller capacity of a power source depending upon a driving frequency.

Apparent from above description, according to the embodiments of the present invention, when so-called multi-pass printing is performed, for the first and the second ejection opening rows, the positions of the ejection openings located at ends of the respective first and the second ejection opening rows on a paper feeding side or a paper discharging side in connection with feeding of a printing medium are apart from each other at a distance of $(m+a)\times L$ (a: positive integer) in a discharging or feeding direction for conveying a printing medium. Or between scanning for completing printing on a first image and first scanning for printing a second image, scanning with performing no printing is executed for an area on which the first image has been printed. Hence, printing an image by the first ejection opening row and printing an image, which is adjacent to the image by the first ejection opening row, by the second ejection opening row are performed while at least a single scanning is executed therebetween. Therefore, it is possible to provide time for fixing ink by the first ejection opening row onto the printing medium.

As a result, an image of high quality can be printed with bleeding between colors reduced.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing method of performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the ejection opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row toward a discharge side regarding moving of the printing medium at a distance (m+a)×L (a is a positive integer), which is measured as a distance between respective ejection openings located at a feed side end regarding the moving of the printing medium.

2. An ink jet printing method as claimed in claim 1, wherein the amount of moving the printing medium after each of m times of scanning for completing the image by means of the first ejection opening row is identical with the amount of moving the printing medium after each of n times of scanning for completing the image by means of the second ejection opening row.

3. An ink jet printing method as claimed in claim 1, wherein the amount of moving the printing medium after each of m times of scanning for completing the image by means of the first ejection opening row is different from the amount of moving the printing medium after each of n times of scanning for completing the image by means of the second ejection opening row.

4. An ink jet printing method as claimed in claim 3, wherein the amount of moving the printing medium after each of m times of scanning for completing the image by means of the first ejection opening row is larger than the amount of moving the printing medium after each of n times of scanning for completing the image by means of the second ejection opening row.

5. An ink jet printing method as claimed in claim 1, wherein a length of the first ejection opening row is identical with a length of the second ejection row.

6. An ink let printing method as claimed in claim 1, wherein a length of the first ejection opening row is different from a length of the second ejection row.

7. An ink jet printing method as claimed in claim 6, where in a length of the first ejection opening row is longer than a length of the second ejection row.

8. An ink jet printing method as claimed in claim 1, wherein a Ka value measured by bristow method for ink ejected from the first ejection row is smaller than the Ka value for ink ejected from the second ejection row.

9. An ink jet printing method as claimed in claim 1, wherein the first ejection opening row ejects black ink.

10. An ink jet printing method as claimed in claim 1, wherein the second ejection opening row ejects a color ink.

11. An ink jet printing method as claimed in claim 10, wherein the color ink comprises at least one of cyan, magenta and yellow.

12. An ink jet printing method as claimed in claim 1, wherein the printing head utilizes thermal energy to generate a bubble and eject ink by means of a pressure of the bubble.

13. An ink jet printing method as claimed in claim 1, wherein printing by scanning the printing head relatively to the printing medium is performed both in a go and return scanning.

14. An ink jet printing method as claimed in claim 1, wherein printing by scanning the printing head relatively to the printing medium is performed in any one of a go and return scanning.

15. An ink jet printing method as claimed in claim 1, wherein printing by means of the first ejection opening row is performed in any one of a go and return scanning, which are scanning the printing head relatively to the printing medium and printing by means of the second ejection opening row is performed in a different scanning from the scanning for the first ejection opening row.

16. An ink jet printing method of performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the ejection opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row, toward a feed side regarding moving of the printing medium at a distance (m+a)×L (a is a positive integer), which is measured as a distance between respective ejection openings located at a discharge side end regarding the moving of the printing medium.

17. An ink jet printing method of performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the election opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row toward a discharge side regarding moving of the printing medium at a distance which is larger than (m+a)×L (a is a positive integer) and is shorter than (m+a+1)×L, the distance being measured as a distance between respective ejection openings located at a feed side end regarding the moving of the printing medium.

18. An ink jet printing method of performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the ejection opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row toward a feed side regarding moving of the printing medium at a distance which is larger than (m+a)×L (a is a positive integer) and is shorter than (m+a+1)×L, the distance being measured as a distance between respective ejection openings located at a discharge side end regarding the moving of the printing medium.

19. An ink jet printing method of performing printing by using a printing head having a first ejection opening row including a plurality of ejection openings ejecting a first kind of ink and a second ejection opening row including a plurality of ejection openings ejecting a second kind of ink different from the first kind of ink, the first and second ejection opening rows being set by selecting ejection openings from respective ejection opening rows for first and second kinds of inks, which rows are arranged to be apart from each other in a direction of scanning the printing head at a predetermined distance and include respective ejection openings overlapping each other in the scanning direction, and by ejecting ink onto a printing medium from the printing head, said method comprising:

controlling the printing for an area, which has a length corresponding to a divided length of an ejection opening arranged length of at least one of the first and second ejection opening rows, to be completed by scanning the at least one of the first and second ejection opening rows to the area a plurality of times, between successive two times of scanning the printing medium is moved at a distance of the divided length, and assigning different ejection opening to the area from each of the plurality of times of scanning, wherein printing of a first image is completed by using the first kind of ink ejected by the first ejection row, then printing of a second image adjacent to the first image completed is completed by using the second kind of ink ejected by the second ejection row, and the time of scanning in which printing is not performed on the area of the first image exists between the time of a last scanning for completing the first image and the time of a first scanning for printing the second image.

20. An ink jet printing apparatus for performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the ejection opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row toward a discharge side regarding moving of the printing medium at a distance (m+a)×L (a is a positive integer), which is measured as a distance between respective ejection openings located at a feed side end regarding the moving of the printing medium.

21. An ink jet printing apparatus as claimed in claim 20, wherein the amount of moving the printing medium after each of m times of scanning for completing the image by means of the first ejection opening row is identical with the amount of moving the printing medium after each of n times of scanning for completing the image by means of the second ejection opening row.

22. An ink jet printing apparatus as claimed in claim 21, wherein the Ka value measured by bristow method for ink ejected from the first ejection row is smaller than the Ka value for ink ejected from the second ejection row.

23. An ink jet printing apparatus as claimed in claim 21, wherein ejection openings of the first ejection opening row eject black ink and ejection openings of the second ejection opening row eject color ink having a higher permeability than the black ink.

24. An ink jet printing apparatus for performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the ejection opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row toward a feed side regarding moving of the printing medium at a distance (m+a)×L (a is a positive integer), which is measured as a distance between respective ejection openings located at a discharge side end regarding the moving of the printing medium.

25. An ink jet printing apparatus for performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the ejection opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row toward a feed side regarding moving of the printing medium at a distance (m+a)×L (a is a positive integer), which is measured as a distance between respective ejection openings located at a discharge side end regarding the moving of the printing medium.

26. An ink jet printing apparatus for performing printing by ejecting ink onto a printing medium from a printing head while scanning the printing head relatively to the printing medium, wherein the printing head is provided, for at least two kinds of ink, with ejection opening rows, each including a plurality of ejection openings arranged in a direction different from a direction of the scanning, the ejection opening rows being arranged to be apart from each other in the scanning direction at a predetermined distance and including respective ejection openings overlapping each other in the scanning direction, wherein printing is performed in which the number of times of scanning is m (m is a positive integer), which is required for completing an image on a predetermined area by means of a first ejection opening row set for use out of the ejection opening rows for the at least two kinds of ink, and the number of times of scanning is n (n is a positive integer), which is required for completing an image on the predetermined area by means of a second ejection opening row set for use out of the ejection opening rows for the at least two kinds of ink, where at least one of m and n is 2 or more, and an amount at which the printing medium is moved for each time of the scanning in a direction different from the direction of the scanning is L (L is a positive integer), wherein the second ejection opening row is staggered, relative to the first ejection opening row toward a feed side regarding moving of the printing medium at a distance (m+a)×L (a is a positive integer), which is measured as a distance between respective ejection openings located at a discharge side end regarding the moving of the printing medium.

27. An ink jet printing method of performing printing by using a printing head having a first ejection opening row including a plurality of ejection openings ejecting a first kind of ink and a second ejection opening row including a plurality of ejection openings ejecting a second kind of ink different from the first kind of ink, the first and second ejection opening rows being set by selecting ejection openings from respective ejection opening rows for first and second kinds of inks, which rows are arranged to be apart from each other in a direction of scanning the printing head at a predetermined distance and include respective ejection openings overlapping each other in the scanning direction, and by ejecting ink onto a printing medium from the printing head, said method comprising:

control means for controlling the printing for an area, which has a length corresponding to a divided length of an ejection opening arranged length of at least one of the first and second ejection opening rows, to be completed by scanning the at least one of the first and second ejection opening rows to the area a plurality of times, between successive two times of scanning the printing medium, is moved at a distance of the divided length, and assigning different ejection opening to the area from each of the plurality of times of scanning, wherein printing of a first image is completed by using the first kind of ink ejected by the first ejection row, then printing of a second image adjacent to the first image completed is completed by using the second kind of ink ejected by the second ejection row, and the time of scanning in which printing is not performed on the area of the first image exists between the time of a last scanning for completing the first image and the time of a first scanning for printing the second image.

28. An ink jet printing method of performing printing by ejecting ink from a printing head while scanning a printing medium with a printing bead, which arranges a first ejection opening row, in which a plurality of ejection openings for ejecting a first kind of ink are arranged in a predetermined direction, and a second ejection opening row, in which a plurality of ejection openings for ejecting a first kind of ink are arranged in a predetermined direction, to be apart from each other in a direction of the scanning at a predetermined distance, said method comprising:

scanning a predetermined area of the printing medium with the printing head plural times to complete printing an image of the predetermined area, at least one of the first and second ejection opening rows faces the predetermined area during each of the plural times of scanning:

wherein said scanning step includes selecting ejection openings used for predetermined from each of the first and second ejection opening rows to perform printing of the predetermined area, so that at least one scanning in which, printing is not performed on the predetermined area exists between the scanning for completing printing of the predetermined area by means of the first ejection opening row and a first scanning for printing the predetermined area by means of the second ejection opening row.

29. A method as claimed in claim 28, wherein the first ejection opening row consists of ejection openings overlapping the ejection openings of the second ejection opening row in the scanning direction and ejection openings not overlapping the ejection openings of the second ejection opening row, and the ejection openings of the first ejection opening row, which overlap the ejection opening of the second ejection opening row, are not selected for ejecting ink and a part of the ejection openings of the first ejection opening row, which does not overlap the ejection opening of the second ejection opening row, is selected for ejecting ink.

30. A method as claimed in claim 29, the first kind of ink is black ink and the second kind of ink is color ink.

31. An ink jet printing method of performing printing by ejecting ink from a printing head while scanning a printing medium with a printing head, which manges a first ejection opening row, in which a plurality of ejection openings for ejecting a first kind of ink are arranged in a predetermined direction, and a second ejection opening row, in which a plurality of ejection openings for ejecting a first kind of ink are arranged in a predetermined direction, to be apart from each other in a direction of the scanning at a predetermined distance, said method comprising:

a first printing step, of scanning a predetermined area of the printing medium with the printing head plural times to complete printing of a first image on the predetermined area by means of the first ejection opening row, the first ejection opening row faces the predetermined area during each of the plural times of scanning, a second printing step, of printing a second image by means of the second ejection opening row, the second image being printed on the predetermined area adjacent to the first image; and a selecting step, of selecting respective ejection openings used for said first and said second printing steps so that scanning, in which printing is not performed exists between a last scanning for printing the first image in said first printing step and first scanning for printing the second image in said second printing step.

32. A method as claimed in claim 31, wherein said second printing step scans the predetermined area plural times with the printing head, in which the second ejection opening row facts the predetermined area dining each of the plural times of scanning, to print the second image on the predetermined area.

33. A method as claimed in claim 32, wherein the first ejection opening row consists of ejection openings overlapping the ejection openings of the second ejection opening row in the scanning direction and ejection openings not overlapping the ejection openings of the second ejection opening row, and in said selecting step, the ejection openings of the first ejection opening row, which overlap the ejection opening of the second ejection opening row are not ejected for printing, and a part of the ejection openings of the first ejection opening row, which does not overlap the ejection opening of the second ejection opening row is selected for printing.

34. A method as claimed in claim 31, wherein the first kind of ink is color ink and the second kind of ink is black ink.

35. A method as claimed in claim 31, wherein the first kind of ink is black ink and the second kind of ink is color ink.

36. An ink jet printing method of performing printing by ejecting ink from a printing head while scanning a printing medium with a printing head, which ranges a first ejection opening row, in which a plurality of ejection openings for ejecting a first kind of ink arranged in a predetermined direction, and a second ejection opening row, in which a plurality of ejection openings for ejecting a first kind of ink are arranged in a predetermined direction, to be apart from each other in a direction of the scanning at a predetermined distance, said method comprising:

a printing step, of performing printing on a predetermined area in which the number of times of scanning is in (m is a positive integer), which is required fur completing a first image on the predetermined ares by means of the first ejection opening row, and the number of times of scanning is n (n is a positive integer), which is required for completing an image on the predetermined area by means of a second ejection opening row, where at least one of in and n is 2 or more, and an amount at which the printing medium is moved for each time of the scanning in a direction perpendicular the direction of the scanning is L (L is a positive integer) and a selecting step, of selecting respective ejection openings used for said printing step from the tint and second ejection opening rows, wherein said selecting step includes selecting the respective ejection openings so that the second ejection opening row is parted from the first ejection opening row toward a discharge side regarding moving of the printing medium at a distance $(m+a)\times L$ (a is a positive integer), which is measured as a distance between respective ejection openings used for printing, which are located at a feed side end regarding the moving of the printing medium.

37. An ink jet printing method of performing printing by ejecting ink from a printing head while scanning a printing medium with a printing head, which arranges a first ejection opening row, in which a plurality of ejection openings for ejecting a first kind of ink are arranged in a predetermined direction, and a second ejection opening row, in which a plurality of ejection openings for ejecting a first kind of ink are arranged in a predetermined direction, to be apart from each other in a direction of the scanning at a predetermined distance, said method comprising:

a printing step, of performing printing on a predetermined area in which the number of times of scanning is a (in is a positive integer), which is required for completing a first image on the predetermined area by means of the first ejection opening row, and the number of times of scanning is n (m is a positive integer). which is required for completing an image on the predetermined area by means of a second ejection opening row, where at least one of m and n is 2 or more, and an amount at which the printing medium is moved for each time of the scanning in a direction perpendicular to the direction of the scanning is L (L is a positive integer); and a selecting step, of selecting respective ejection openings used for said printing step from the first and second ejection opening rows, wherein said selecting step includes selecting the respective ejection openings so that the second ejection opening row is parted from the first ejection opening row toward a feed side regarding moving of the punting medium at a distance (m+a)×L (a is a positive integer), which is measured as a distance between respective ejection openings used for printing, which are located at a discharge side end regarding the moving of the printing medium.

* * * * *

UNITED STATES PATENT AND TRADEMARK OFFICE

CERTIFICATE OF CORRECTION

PATENT NO. : 6,719,403 B2
DATED : April 13, 2004
INVENTOR(S) : Hidehiko Kanda et al.

It is certified that error appears in the above-identified patent and that said Letters Patent is hereby corrected as shown below:

Column 2,
Line 8, “on” should read -- as --.

Column 3,
Line 8, “above mentioned” should read -- above-mentioned --;
Line 11, “is” should read -- are --; and
Line 43, “image” should read -- an image is --.

Column 4,
Lines 14 and 51, “form” should read -- from --;

Column 5,
Line 42, “form” should read -- from --; and
Line 52, “forth” should read -- fourth --.

Column 6,
Lines 5 and 63, “form” should read -- from --;

Column 7,
Line 24, “form” should read -- from --; and
Line 52, “form” should read -- from --.

Column 8,
Line 15, “form” should read -- from --.

Column 11,
Line 40, “respective the” should read -- the respective --.

Column 16,
Line 6, “above mentioned” should read -- above-mentioned --.

Column 17,
Line 57, “above mentioned” should read -- above-mentioned --.

Column 18,
Line 21, “measure” should read -- measured --.

UNITED STATES PATENT AND TRADEMARK OFFICE

CERTIFICATE OF CORRECTION

PATENT NO. : 6,719,403 B2
DATED : April 13, 2004
INVENTOR(S) : Hidehiko Kanda et al.

It is certified that error appears in the above-identified patent and that said Letters Patent is hereby corrected as shown below:

Column 20,
Line 65, “integer),” should read -- integer), and --.

Column 21,
Line 32, “where” should read -- wherein --; and
Line 33, “in” should be deleted.

Column 22,
Lines 22 and 55, “integer),” should read -- integer), and --.

Column 23,
Line 22, “integer),” should read -- integer), and --; and
Line 53, “opening” should read -- openings --.

Column 24,
Line 22, “integer),” should read -- integer), and --;

Column 25,
Line 6, “integer),” should read -- integer), and --;
Line 40, “integer),” should read -- integer), and --.
Column 26,
Line 8, “integer),” should read -- integer), and --;
Line 16, “method of” should read -- apparatus for --;
Line 38, “opening” should read -- openings --;
Line 51, “bead,” should read -- head, --;
Line 64, “scanning:” should read -- scanning; --; and
Line 66, “predetermined” should read -- printing --.

Column 27,
Line 3, “which,” should read -- which -- ;
Line 26, “manges” should read -- arranges --;
Line 45, “steps” should read -- steps, --;
Line 46 “performed” should read -- performed, --; and
Line 53, “facts” should read -- faces -- and “dining” should read -- driving --.

UNITED STATES PATENT AND TRADEMARK OFFICE

CERTIFICATE OF CORRECTION

PATENT NO. : 6,719,403 B2
DATED : April 13, 2004
INVENTOR(S) : Hidehiko Kanda et al.

It is certified that error appears in the above-identified patent and that said Letters Patent is hereby corrected as shown below:

Column 28,
Line 10, “ranges” should read -- arranges --.
Line 12, “ink” should red -- ink are --;
Line 19, “in” (second occurrence) should read -- — --;
Line 20, “fur” should read -- for --;
Line 21, “ares” should read -- area --;
Line 26, “in” should read -- — --;
Line 28, “the” should read -- to the --;
Line 29, “integer) and” should read -- integer); and --;
Line 31, “tint” should read -- first --;
Line 53, “a (in” should read -- m ( --; and
Line 57, “(m” should read -- (--.

Column 29,
Line 4, “punting” should read -- printing --.

Signed and Sealed this

Thirty-first Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,719,403 B2
DATED : April 13, 2004
INVENTOR(S) : Hidehiko Kanda et al.

It is certified that error appears in the above-identified patent and that said Letters Patent is hereby corrected as shown below:

Column 25,
Line 42, "feed" should read -- discharge --;
Line 44, "distance (m + a) x L (a is a positive integer), which is" should read -- distance which is larger than (m + a) x L (a is a positive integer) and is shorter than (m + a + 1) x L, the distance being --; and
Line 46, "discharge" should read -- feed --.

Column 26,
Line 12, "distance (m + a) x L (a is a positive integer), which is" should read -- distance which is larger than (m + a) x L (a is a positive integer) and is shorter than (m + a + 1) x L, the distance being --.

Signed and Sealed this

Eighth Day of November, 2005

JON W. DUDAS
*Director of the United States Patent and Trademark Office*